US006262009B1

(12) United States Patent
Rogers et al.

(10) Patent No.: US 6,262,009 B1
(45) Date of Patent: Jul. 17, 2001

(54) COVERED CLEANING SHEET

(75) Inventors: Steven Barrett Rogers; Bruce Albert Yeazell, both of Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/381,925

(22) PCT Filed: Mar. 2, 1998

(86) PCT No.: PCT/IB98/00260

§ 371 Date: Sep. 27, 1999

§ 102(e) Date: Sep. 27, 1999

(87) PCT Pub. No.: WO98/44185

PCT Pub. Date: Oct. 8, 1998

Related U.S. Application Data

(60) Provisional application No. 60/041,006, filed on Mar. 27, 1997.

(51) Int. Cl.[7] ..... C11D 17/04; D06L 1/00

(52) U.S. Cl. ..... 510/439; 510/277; 510/291; 510/293; 510/295; 8/137; 8/142

(58) Field of Search ..... 510/439, 291, 510/293, 295, 277; 8/137, 142

(56) References Cited

U.S. PATENT DOCUMENTS

| | | | | |
|---|---|---|---|---|
| 2,552,853 | | 5/1951 | Isserstedt | 68/213 |
| 5,630,848 | * | 5/1997 | Young et al. | 8/137 |
| 5,762,648 | * | 6/1998 | Yeazell et al. | 8/137 |
| 5,789,368 | * | 8/1998 | You et al. | 510/297 |
| 5,840,675 | * | 11/1998 | Yeazell | 510/439 |

FOREIGN PATENT DOCUMENTS

| | | | |
|---|---|---|---|
| 0 217 186 A1 | 4/1987 | (EP) | C11D/17/04 |
| 0 429 172 A1 | 5/1991 | (EP) | D06F/43/00 |
| WO 97/32004 | 9/1997 | (WO) | C11D/17/04 |

* cited by examiner

*Primary Examiner*—Lorna M. Douyon
(74) *Attorney, Agent, or Firm*—C. Brant Cook; Kim William Zerby; Steven W. Miller

(57) ABSTRACT

The present invention encompasses an article for treating fabrics, comprising a) an absorbent carrier substrate; and b) a liquid cleaning/refreshment composition releasably absorbed in said substrate; said substrate being wholly or partly covered by; c) a fibrous coversheet which is permeable to said cleaning/refreshment composition in the liquid and/or vapor state, said coversheet having a minimum thickness of about 7 mil (0.18 mm). The coversheet helps reduce water spotting on the fabrics being treated and picks up lint and solid soils. The article is useful in an in-home process which is conducted in a clothes dryer.

15 Claims, 4 Drawing Sheets

COVERED CLEANING SHEET

This appli is a 371 of PCT/IB98/00260 filed Mar. 2, 1997 and also claims the benefit of Provisional No. 60/041,006 Mar. 27, 1997.

TECHNICAL FIELD

The present invention relates to article which are designed to clean and refresh fabrics without leaving water marks.

BACKGROUND OF THE INVENTION

By classical definition, the term "dry cleaning" has been used to describe processes for cleaning textiles using non-aqueous solvents. Dry cleaning is an old art, with solvent cleaning first being recorded in the United Kingdom in the 1860's. Typically, dry cleaning processes are used with garments such as woolens which are subject to shrinkage in aqueous laundering baths, or which are judged to be too valuable or too delicate to subject to aqueous laundering processes. Various hydrocarbon and halocarbon solvents have traditionally been used in immersion dry cleaning processes, and the need to handle and reclaim such solvents has mainly restricted the practice of conventional dry cleaning to commercial establishments.

Together with the soil and stain removal aspects of a typical dry cleaning process, there is also a consumer need for what can be termed fabric "refreshment" compositions and processes. Thus, fabrics which have lint, hair or other solid debris clinging to their surfaces, which may have absorbed malodors, or which have become wrinkled and otherwise lost their fresh appearance, are often subjected to conventional commercial dry cleaning processes mainly to reestablish their freshness aspect.

Attempts have been made to provide in-home dry cleaning systems. One type of in-home system for cleaning and refreshing garments comprises a carrier sheet containing various liquid or gelled cleaning agents, and a plastic bag. The garments are placed in the bag together with the sheet, and then tumbled in a conventional clothes dryer. In a current commercial embodiment, multiple single-use flat sheets comprising a gelled cleaning agent and a single multi-use plastic bag are provided in a package. Unfortunately, such in-home processes are sub-optimal with respect to the removal of lint and other solid debris from fabric surfaces. It has now also been unexpectedly discovered that when such processes use liquid water-based cleaning agents they can leave unsightly water marks (aka "wet strikes") on certain types of fabrics in localized areas where the fabrics come in contact with the carrier sheet. This formation of water marks can be of concern to the user, especially on certain silk fabrics where the marks can have the appearance of oily stains.

The present invention provides improved pick-up and removal of lint and other particulate matter from fabrics which are being cleaned and/or refreshed in an in-home process. Importantly, this invention also minimizes or eliminates the occurrence of water marks on the treated fabrics. These advantages are secured by means of the coversheets used herein.

BACKGROUND ART

WO 97/00993A1, published Jan. 9, 1997 to Weller, et al.; WO 97/00990A2, published Jan. 9, 1997 to Tyerech, et al.; GB 2,302,553A published Jan. 22, 1997 to Telesca, et al.; GB 2,302,878A, published Feb. 5, 1997 to Weller, et al.; and GB 2,302,879A, published Feb. 5, 1997 to Sidoti, et al. all relate to in-dryer fabric cleaning. U.S. Pat. No. 4,532,722 issued to S. H. Sax, Aug. 6, 1985, relates to a fabric conditioning device for use in a laundry dryer. A peracid-containing dry cleaning composition is described in U.S. Pat. No. 4,013,575, issued to H. Castrantas, et al., Mar. 22, 1997. Dry cleaning processes are disclosed in: U.S. Pat. No. 5,591,236, issued Jan. 7, 1997 to Roetker; U.S. Pat. No. 5,547,476, issued Aug. 20, 1996, to Siklosi and Roetker; EP 429,172A1, published May 29, 1991, Leigh, et al.; and in U.S. Pat. No. 5,238,587, issued Aug. 24, 1993, Smith, et al. Other references relating to dry cleaning compositions and processes, as well as wrinkle treatments for fabrics, include: GB 1,598,911; and U.S. Pat. Nos. 4,126,563, 3,949,137, 3,593,544, 3,647,354, 3,432,253 and 1,747,324; and German applications 2,021,561 and 2,460,239, 0,208,989 and 4,007,362. Cleaning/pre-spotting compositions and methods are also disclosed, for example, in U.S. Pat. Nos. 5,102,573; 5,041,230; 4,909,962; 4,115,061; 4,886,615; 4,139,475; 4,849,247; 5,112,358; 4,659,496; 4,806,254; 5,213,624; 4,130,392; and 4,395,261. Sheet substrates for use in a laundry dryer are disclosed in Canadian 1,005,204, U.S. Pat. Nos. 3,956,556 and 4,007,300 relate to perforated sheets for fabric conditioning in a clothes dryer. U.S. Pat. No. 4,692,277 discloses the use of 1.2-octanediol in liquid cleaners. See also U.S. Pat. Nos. 3,591,510; 3,737,387; 3,764,544; 3,882,038; 3,907,496; 4,097,397; 4,102,824; 4,336,024; 4,594,362; 4,606,842; 4,758,641; 4,797,310; 4,802,997; 4,943,392; 4,966,724; 4,983,317; 5,004,557; 5,062,973; 5,080,822, 5,173,200; EP 0 213 500; EP0 261 718; G.B. 1,397,475; WO 91/09104; WO 91/13145; WO 93/25654 and Hunt, D. G. and N. H. Morris, "PnB and DPnB Glycol Ethers". *HAPPI*, April 1989, pp. 78–82.

SUMMARY OF THE INVENTION

The present invention encompasses an article for treating fabrics, comprising:

a) an absorbent carrier substrate; and b) a liquid cleaning/refreshment composition releasably absorbed in said substrate; said substrate being wholly (preferred) or partly covered by;

c) a fibrous coversheet which is permeable to said cleaning/refreshment composition in the liquid and/or vapor state, said coversheet having a minimum thickness (uncompressed) of at least about 7 mils (0.18 mm) or above, preferably at least about 8 mils (0.2 mm).

In a preferred mode, the coversheet substantially envelops and encases said substrate. In a highly preferred mode, the substrate is in the form of a planar sheet which, in-use, is maintained in its original configuration relative to the coversheet by bonding to said coversheet at discrete areas.

The cleaning/refreshment composition used herein comprises water and optionally a member selected from the group consisting of organic solvents, organic surfactants, auxiliary cleaning agents, and mixtures thereof. In a preferred mode, the cleaning/refreshment composition comprises water and a surfactant, especially a nonionic surfactant, e.g. an ethoxylated alcohol or ethoxylated alkyl phenol surfactant.

The invention thus provides articles of manufacture in sheet form which are specifically adapted to clean and/or refresh fabrics in a hot air clothes dryer, comprising:

(a) a core element which comprises an aborbent carrier substrate in sheet form;

(b) a liquid cleaning refreshment composition (preferably from about 10 grams to about 30 grams) comprising at least about 95% by weight, of water releasably absorbed in said core element;

(c) a permeable coversheet encasing the outer surfaces of said core element. In a preferred embodiment, the cleaning/refreshment composition comprises up to abut 2%, by weight, of a nonionic surfactant.

The invention also provides an overall non-immersion cleaning/refreshment process for treating a fabric, which optionally comprises a prespotting operation, and comprising the overall steps of:

(a) optionally, applying a spot cleaning composition from a dispenser to a discrete stained area of said fabric;

(b) optionally, concurrently or consecutively with Step (a), contacting the stained area of the fabrics with the treatment members of a convex cleaning device or with a dispenser tip affixed to said dispenser and applying Z-directional force to said device or to said tip;

(c) placing the fabric together with an article according to this invention in a containment bag, preferably of the vapor-venting type;

(d) placing the bag in a hot air clothes dryer (or similar apparatus to provide heat and tumbling) and operating the dryer with heat and tumbling; and (e) removing the fabric from the bag.

In an optional Step (b), it is preferred that the stained area of fabric being treated is underlaid with a stain receiver, as disclosed more fully hereinafter.

For the convenience of the consumer, a kit is provided, comprising:

(a) multiple articles according to this invention comprising a sheet-form absorbent substrate encased in the herein-described coversheet, said substrate releasably containing an aqueous cleaning/refreshment composition;

(b) a re-usable containment bag, preferably of the venting type;

(c) optionally, a convex cleaning device;

(d) optionally, a separate portion of a spot cleaning composition, preferably in a dispenser which comprises a dispensing tip;

(e) optionally, a re-usable holding tray; and (f) optionally, one or more absorbent stain receivers.

All percentages, ratios and proportions herein are by weight, unless otherwise specified. All documents cited are, in relevant part, incorporated herein by reference.

DETAILED DESCRIPTION OF THE INVENTION

The individual materials employed to assemble the fabric cleaning/refreshment article of the present invention are commercially available. The terms used herein to describe such materials have their conventional meanings. For purposes of clarity, certain terms used herein are defined in the text.

Figure 1:
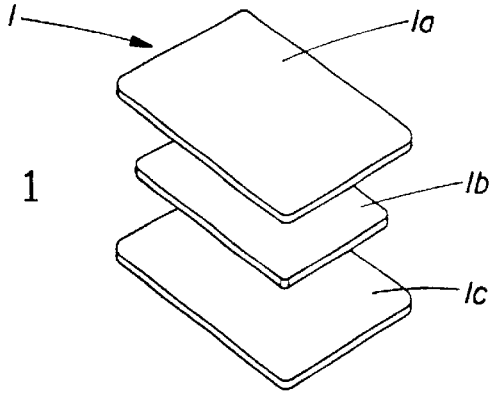
FIG. 1 is an exploded view of the article (1) herein in a pre-assembled state.

As shown in FIG. 1, an article (1) of the present type can be assembled as a laminate comprising a topmost fibrous sheet **(1*a*), an absorbent carrier sheet as the core (1*b*) and a bottommost fibrous sheet (1*c*)**. The combination of topsheet and bottomsheet comprises the "coversheet" in the preferred embodiment of the article herein.

Figure 2:
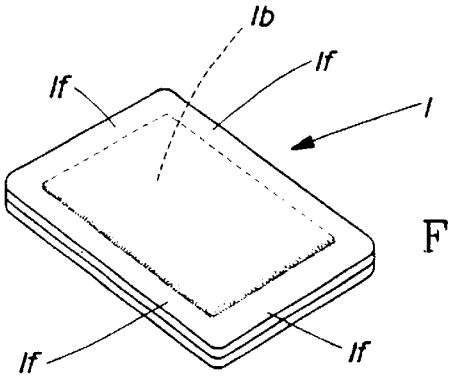
FIG. 2 is a perspective of an assembled cleaning/refreshing article (1) of the present invention in sheet form.

The assembled laminate article (1) is shown in FIG 2. FIG 2 also shows the bond **(1*f*)** which extends around the periphery of the article. The purpose of this bond is to ensure that the absorbent carrier core maintains its original configuration relative to the coversheet when the article is being used in the manner of this invention. Stated simply, it has been discovered that if the absorbent sheet which comprises the core is not bonded to the "envelope" provided by the coversheet in-use, the carrier sheet tends to crumple and bunch-up inside the coversheet. This can interfere with the delivery of the cleaning/refreshment composition to the fabrics being treated.

Moreover, it has also been discovered that is not preferred to tightly bond the coversheet to the carrier sheet across the entire face of the carrier sheet. Tightly bonding the coversheet closely to the carrier sheet can allow some liquid transfer to occur through the coversheet. Accordingly, the carrier sheet is bonded to the coversheet only in discrete areas. In one embodiment as shown in FIG. 2, this bonding is only around the periphery of the article. In another embodiment, spot-bonding at discrete areas across the face of the article can be employed. Various other bond patterns can be used. Preferably, the bonding is done at no more than about 50% of the area of the article, more preferably no more than about 10% of the area of the article, most preferably no more than about 1% of the area of the article.

Coversheet—The coversheets employed herein are distinguished from the carrier substrate sheets, inasmuch as the coversheets are relatively non-absorbent to the liquid cleaning/refreshment compositions as compared with the carrier sheets. The coversheets are constructed from hydrophobic fibers which tend not to absorb, "wick" or otherwise promote the transfer of fluids. While fluids can pass through the void spaces between the fibers of the coversheet, this occurs mainly when excessive pressure is applied to the article. Thus, under typical usage conditions the coversheet provides a physical barrier which keeps the absorbent carrier, which is damp from is load of cleaning/refreshment composition, from coming into direct contact with the fabrics being treated. Yet, the coversheet does allow vapor transfer of the cleaning/refreshment composition from the carrier through the coversheet and into the containment bag, and thence onto the fabrics being treated.

The coversheet herein comprises a fibrous, permeable nonwoven or woven fabric. Such nonwoven or woven fibrous coversheets offer advantages over formed-film type coversheets known in the catamenials art. For example, formed-film coversheets are often manufactured by hydroforming processes which are particularly suitable with polymer films such as polyethylene. While polyethylene can be used herein, there is some prospect that, due to its lower melting point, high dryer temperatures can cause its softening and/or melting in-use. This is particularly true if the article herein were to be released from the containment bag and fall into the hot dryer drum. While it is possible to prepare formed-film topsheets using nylon, polyester or other heat resistant polymeric sheets, such manufacture becomes somewhat more difficult and, hence, more expensive.

It has now also been determined that the coversheet herein should be of a thickness which effectively provides the physical barrier function. Even though made from hydrophobic fibers, if the coversheet is too thin, fluid passage can occur under the intended usage conditions. Accordingly, it has now been determined that the thickness of the coversheet should preferably be at least about 7 mils (0.18 mm), preferably from about 0.2 mm to about 0.6 mm. It has also been determined that the fibers used in the coversheet are preferably hydrophobic and preferably have a melting point above about 240° C.

Fibrous coversheets for use herein can readily be made from non-heat resistant fibers such as polyethylene. However, it has now been determined that preferred fibrous coversheets can be prepared using nylon (especially nylon-6), polyester, and the like, heat-resistant fibers which can withstand even inadvertent misuse in the present process. The flexible, cloth-like, permeable topsheets made therefrom are conventional materials in the art of nonwoven and woven fabric making, and their manufacture forms no part of the instant invention. Nonwoven fabrics for use as coversheets are available commercially from companies such as Reemay, Inc., Hickory, Tenn. Such coversheets also pick up solid dust particles, vagrant lint and other fibers from the fabrics being treated in the present process, thereby enhancing the overall clean/refreshed appearance of the fabrics following the treatment herein.

Such nonwoven or woven fibrous sheet materials can be used in a flat single layer or as multiple layers as the coversheet for the absorbent carrier core herein. In another embodiment, the absorbent core carrying the cleaning/refreshment composition is enrobed in a polyester or polyamide fibrous coversheet which has been ring rolled or otherwise crimped to provide three dimensional bulk. Optionally, this coversheet may be further covered by a second coversheet in an uncrimped configuration.

Such fibrous, preferably heat resistant and, most preferably, hydrophobic, coversheets thus provide various embodiments of the article herein. Suitable combinations can be employed, according to the desires of the manufacturer, without departing from the spirit and scope of the invention. If desired, the coversheet can be provided with macroscopic fenestrations through which the lint, fibers or particulate soils can pass, thereby further helping to entrap such foreign matter inside the article, itself.

A typical spun-bonded fibrous coversheet herein is commercially available from Reemay and has the following characteristics.

(a) Fabric Type—Non-woven, semi-dull, whitened homopolymer 100% virgin, spun-bonded polyester.

(b) Fiber Type—6.0 Denier straight, tri-lobal continuous fiber, copolymer polyester.

| Web Properties | Target | Range |
|---|---|---|
| a) Basis weight, roll average oz/yd$^2$ | 0.54 | 0.52 to 0.59 |
| b) Thickness | 8 mil | 7–8 mil |
| c) Fuzz level | | |

As measured by Reemay sled/drag method based on 0–5 scale. 5 being no fuzz level.

| | | | |
|---|---|---|---|
| Belt side | 2.5 | 5.0 | 1.8 |
| Jet side | 3.4 | 5.0 | 2.6 |

Carrier—When used in the in-dryer step of the present process, the cleaning and/or refreshment compositions are used in combination with an absorbent carrier substrate. The carrier releasably contains the compositions. By "releasably contains" means that the compositions are effectively released from the carrier onto the soiled fabrics as part of the non-immersion cleaning and/or fabric refreshment processes herein. This release occurs mainly by volatilization of the composition from the carrier substrate through the vapor-permeable coversheet, or by a combination of vapor and liquid transfer, although bulk liquid transfer is desirably minimized by means of the coversheet herein.

The carrier can be in any desired form, such as powders, flakes, shreds, and the like. However, it is highly preferred that the carrier be in the form of an integral pad or sheet which substantially maintains its structural integrity throughout the process. Such pads or sheets can be prepared, for example, using well-known methods for manufacturing non-woven sheets, paper towels, fibrous batts, cores for bandages, diapers and catamenials, and the like, using materials such as wood pulp, cotton, rayon, polyester, fibers, and mixtures thereof. Woven cloth pads may also be used, but are not preferred over non-woven pads due to cost considerations. Integral carrier pads or sheets may also be prepared from natural or synthetic sponges, foams, and the like.

The carriers are designed to be safe and effective under the intended operating conditions of the present process. The carriers must not be flammable during the process, nor should they deleteriously interact with the cleaning or refreshment composition or with the fabrics being cleaned. In general, non-woven polyester-based pads or sheets are quite suitable for use as the carrier herein.

The carrier used herein is most preferably non-linting. By "non-linting" herein is meant a carrier which resists the shedding of visible fibers or microfibers onto the fabrics being cleaned, i.e., the deposition of what is known in common parlance as "lint". A carrier can easily and adequately be judged for its acceptability with respect to its non-linting qualities by rubbing it on a piece of dark blue woolen cloth and visually inspecting the cloth for lint residues.

The non-linting qualities of sheet or pad carriers used herein can be achieved by several means, including but not limited to: preparing the carrier from a single strand of fiber; employing known bonding techniques commonly used with nonwoven materials. e.g., point bonding, print bonding, adhesive/resin saturation bonding, adhesive/resin spray bonding, stitch bonding and bonding with binder fibers.

The size of the carrier should not be so large as to be unhandy for the user. Typically, the dimensions of the carrier will be sufficient to provide a macroscopic surface area (both sides of the carrier) of at least about 360 $cm^2$, preferably in the range from about 360 $cm^2$ to about 3000 $cm^2$. For example, a generally rectangular carrier may have the dimensions (X-direction) of from about 20 cm to about 35 cm, and (Y-direction) of from about 18 cm to about 45 cm.

The carrier is intended to contain a sufficient amount of the cleaning/refreshment compositions to be effective for their intended purpose. The capacity of the carrier for such compositions will vary according to the intended usage. For example, pads or sheets which are intended for a single use will require less capacity than such pads or sheets which are intended for multiple uses. For a given type of carrier the capacity for the cleaning or refreshment composition will vary mainly with the thickness or "caliper" (Z-direction; dry basis) of the sheet or pad. For purposes of illustration, typical single-use polyester sheets used herein will have a thickness in the range from about 0.1 mm to about 0.7 mm and a basis weight in the range from about 30 $g/m^2$ to about 100 $g/m^2$. Typical multi-use polyester pads herein will have a thickness in the range from about 0.2 mm to about 1.0 mm and a basis weight in the range from about 40 $g/m^2$ to about 150 $g/m^2$. Open-cell sponge sheets will range in thickness from about 0.1 mm to about 1.0 mm. Of course, the foregoing dimensions may vary, as long as the desired quantity of the cleaning or refreshment composition is effectively provided by means of the carrier.

A preferred carrier herein comprises a binderless (or optional low binder), hydroentangled absorbent material, especially a material which is formulated from a blend of cellulosic, rayon, polyester and optional bicomponent fibers. Such materials are available from Dexter, Non-Wovens Division, The Dexter Corporation as HYDRASPUN®, especially Grade 10244 and 10444. The manufacture of such materials forms no part of this invention and is already disclosed in the literature. See, for example, U.S. Pat. No. 5,009,747, Viazmensky, et al., Apr. 23, 1991 and U.S. Pat. No. 5,292,581, Viazmensky, et al., Mar. 8, 1994, incorporated herein by reference. Preferred materials for use herein have the following physical properties.

| | Grade 0244 | Targets | Optional Range |
|---|---|---|---|
| Basis Weight | $gm/m^2$ | 55 | 35–75 |
| Thickness | microns | 355 | 100–1500 |
| Density | gm/cc | 0.155 | 0.1–0.25 |
| Dry Tensile | gm/25 mm | | |
| MD | | 1700 | 400–2500 |
| CD | | 650 | 100–500 |
| Wet Tensile | gm/25 mm | | |
| MD* | | 700 | 200–1250 |
| CD* | | 300 | 100–500 |
| Brightness | % | 80 | 60–90 |
| Absorption Capacity | % | 735 | 400–900 ($H_2O$) |
| Dry Mullen | $gm/cm^2$ | 1050 | 700–1200 |

*MD - machine direction: CD - cross direction

As disclosed in U.S. Pat. No. 5,009,747 and U.S. Pat. No. 5,292,281, the hydroentangling process provides a non-woven material which comprises cellulosic fibers, and preferably at least about 5% by weight of synthetic fibers, and requires less than 2% wet strength agent to achieve improved wet strength and wet toughness.

Surprisingly, this hydroentangled carrier is not merely a passive absorbent for the cleaning/refreshment compositions herein, but actually helps optimize cleaning performance. While not intending to be limited by theory, it may be speculated that this carrier is more effective in delivering the compositions to soiled fabrics, perhaps due to its mixtures of fibers. Whatever the reason, improved cleaning performance is secured.

It has also been discovered that this hydroentangled carrier material provides an additional, unexpected benefit due to its resiliency. In-use, the articles herein are designed to function in a substantially open configuration. However, the articles may be packaged and sold to the consumer as sheets which are in a folded configuration. It has been discovered that the carrier sheets made from conventional materials tend to undesirably revert to their folded configuration in-use. Indeed, this tendency to re-fold along the original fold lines seems to be exacerbated by the coversheet materials used herein. While the hydroentangled materials used to form the carrier sheet herein have less tendency to re-fold during use than do other carrier materials, it has been determined experimentally that up to 60% refold does seem to occur under intended usage conditions when the coversheet is present. In some instances, and especially with certain types of fabrics, this can be problematic, inasmuch as wet strikes can occur along the sharp fold lines, presumably due to pressure forcing the liquid composition through the fibrous coversheet.

However, it has now be determined that by providing holes or otherwise fenestrating the carrier sheet, this tendency to re-fold substantially lessened even when the coversheet is used in the manner of the present invention. Thus, in preferred mode of practicing the present invention a plurality of holes, slits, or other fenestrations are placed in the carrier sheet to help minimize re-fold when the article is used. The number and placement of the holes or fenestrations can be determined by routine experimentation. Example I hereinafter gives the size and number of circular holes which are useful for an article of the size and with the load of cleaning/refreshment compositions described therein.

Compositions—The user of the present process can be provided with various compositions to use in the optional pre-spotting procedure and on the article of the invention. One problem associated with known fabric treatment compositions is their tendency to leave visible residues on fabric surfaces. Such residues are problematic and are preferably to be avoided herein since the present process does not involve conventional immersion or rinse steps. Accordingly, the compositions used herein should, not preferably, be substantially free of various polyacrylate-based emulsifiers, polymeric anti-static agents, inorganic builder salts and other residue-forming materials, except at low levels of about 0.1%–0.3%, and preferably 0%, of the final compositions. Water used in the compositions should preferably be distilled, deionized or otherwise rendered free of residue-forming materials. Stated otherwise the compositions herein should be formulated so as to leave substantially no visible residue on fabrics being treated according to the practice of this invention.

Accordingly, in a preferred aspect of this invention there are provided cleaning/refreshment compositions which are substantially free of materials which leave visible residues on the treated fabrics. This necessarily means that the preferred compositions are formulated to contain the highest level of volatile materials possible, preferably water, typically about 95%, preferably about 97.7%, and surfactant at levels of about 0.1% to about 0.7%. A preferred pre-spotting composition will also contain a cleaning solvent such as butoxy propoxy propanol (BPP) at a low, but effective, level, typically about 1% to about 4%, preferably about 2%.

Advantageously, when thus formulated such compositions exist as phase-stable aqueous solutions rather than as suspensions or emulsions. Thus, such compositions do not require use of additional emulsifiers, thickening agents, suspending agents, gelling agents, and the like, all of which can contribute to the formation of undesirable visible residues on the fabric.

Indeed, as an overall proposition, any of the chemical compositions which are used to provide the pre-spotting and the overall cleaning and/or refreshment functions herein comprises ingredients which are safe and effective for their intended use, and, as noted above, preferably do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. In this regard, it is recognized that the solvents typically used in immersion dry cleaning processes can remove some portion of certain types of dyes from certain types of fabrics. However, such removal is tolerable in immersion processes since the dye is removed relatively uniformly across the surface of the fabric. In contrast, it has now been determined that high concentrations of certain types of cleaning ingredients at specific sites on fabric surfaces can result in unacceptable localized dye removal. The preferred compositions herein are formulated to minimize or avoid this problem.

The dye removal attributes of the present compositions can be compared with art-disclosed cleaners using photographic or photometric measurements, or by means of a simple, but effective, visual grading test. Numerical score units can be assigned to assist in visual grading and to allow for statistical treatment of the data, if desired. Thus, in one such test, a colored garment (typically, silk, which tends to be more susceptible to dye loss than most woolen or rayon fabrics) is treated by padding-on cleaner/refresher compositions using an absorbent, white paper hand towel. Hand pressure is applied, and the amount of dye which is transferred onto the white towel is assessed visually. Numerical units ranging from: (1) "I think I see a little dye on the towel"; (2) "I know I see some dye on the towel"; (3) I see a lot of dye on the towel"; through (4) "I know I see quite a lot of dye on the towel" are assigned by panelists.

In addition to the foregoing considerations, the compositions used herein are preferably formulated such that they are easily dispensed and not so adhesive in nature that they render spot-cleaning unhandy. However, and while not intending to be limiting of the present invention, the preferred compositions disclosed herein afford a spot-cleaning process which is both effective and aesthetically pleasing when used with the devices described herein.

Aqueous Spot Stain Cleaning Compositions (a) Bleach—The compositions herein may optionally comprise from about 0.25% to about 7%, by weight, of hydrogen peroxide. If used, preferred spot cleaners will comprise 0.5 to about 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Solvent—The compositions herein may comprise from about 0% to about 10% by weight, of butoxy propoxy propanol (BPP) solvent. Preferred spot cleaners will comprise 1–4% BPP.

(c) Water—The preferred, low residue compositions herein may comprise from about 90%, preferably from about 95.5% to about 99.9%, by weight, of water.

(d) Surfactant—The compositions herein may optionally comprise from about 0.05% to about 2% by weight, of surfactants, such as MgAES and $NH_4$AES, amine oxides, ethoxylated alcohols or alkyl phenols, alkyl sulfates, and mixtures thereof. As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.4% $MgAE_1S$/0.4% $C_{12}$ dimethyl amine oxide. Another preferred composition comprises 4% BPP/0.4% AS.

(e) Optionals—The compositions herein may comprise minor amounts of various optional ingredients, including bleach stabilizers, perfumes, preservatives, and the like. If used, such optional ingredients will typically comprise from about 0.05% to about 2% by weight, of the compositions, having due regard for residues on the cleaned fabrics.

(f) Chelator—Compositions which contain $H_2O_2$ will also typically contain a chelating agent. The chelating agent is selected from those which, themselves, are stable in aqueous $H_2O_2$ and which stabilize the $H_2O_2$ by chelating vagrant metal ions. Such chelating agents are typically already present at low, peroxide-stabilizing amount (0.01–1%) in commercial sources of hydrogen peroxide. A variety of phosphonate chelators are known in stabilizing $H_2O_2$. The amino phosphonates are especially useful for this purpose. Various amino phosphonates are available as under the DEQUEST® trade name from the Monsanto Company, St. Louis, Mo. Representative, but non-limiting, examples include ethylenediamine tetrakis (methylene phosphonic) acid, diethylenetriamine penta(methylene phosphonic) acid, and the water-soluble salts thereof. Amino tris (methylene phosphonic) acid or its water-soluble salts (as DEQUEST 2000® is a preferred chelator.

The pH range of the pre-spotting compositions helps provide stability to the hydrogen peroxide and is typically in the acid-slightly basic range from about 3 to about 8, preferably about 6.

Organic Solvent—The preferred cleaning (especially including spot cleaning) solvent herein is butoxy propoxy propanol (BPP) which is available in commercial quantities as a mixture of isomers in about equal amounts. The isomers, and mixtures thereof, are useful herein. The isomer structures are as follows:

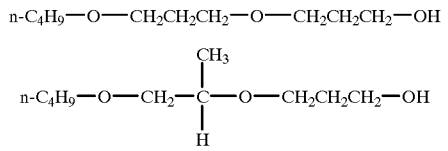

-continued

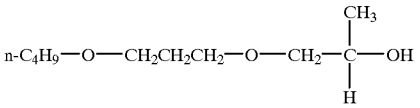

While the spot cleaning compositions herein function quite well with only the BPP, water and surfactant, they may also optionally contain other ingredients to further enhance their stability. Hydrotropes such as sodium toluene sulfonate and sodium cumene sulfonate, short-chain alcohols such as ethanol and isopropanol, and the like, can be present in the compositions. If used, such ingredients will typically comprise from about 0.05% to about 5%, by weight, of the stabilized compositions herein.

Surfactants—Nonionics such as the ethoxylated $C_{10}$–$C_{16}$ alcohols, e.g., NEODOL 23-6.5, can be used in the compositions. The alkyl sulfate surfactants which may be used herein as cleaners and to stabilize aqueous compositions are the $C_8$–$C_{18}$ primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_xSO_3Z$, wherein R is $C_{10}$–$C_{16}$ alkyl, EO is —$CH_2CH_2$—O—, x is 1–10 and can include mixtures which are conventionally reported as averages, e.g., $(EO)_{2.5}$. $(EO)_{6.5}$ and the like, and Z is a cation such as sodium ammonium or magnesium (MgAES). The $C_{12}$–$C_{16}$ alkyl dimethyl amine oxide surfactants can also be used. A preferred mixture comprises $MgAE_1S/C_{12}$ dimethyl amine oxide at a weight ratio of about 10:1. Other surfactants which improve phase stability and which optionally can be used herein include polyhydroxy fatty acid amides, e.g., $C_{12}$–$C_{14}$ N-methyl glucamide. AS stabilized compositions preferably comprise 0.1%–0.5%, by weights, of the compositions herein. MgAES and amine oxides, if used, can comprises 0.1%–2%, by weight, of the compositions. The other surfactants can be used at similar levels.

Having due regard to the foregoing considerations, the following illustrates the various other ingredients which can be used in the liquid compositions herein, but is not intended to be limited thereof. In general, the spot cleaning compositions are formulated to be somewhat "stronger" in cleaning power than the cleaning/refreshment compositions, although this can be varied, according to the desires of the formulator.

Other Optionals—In addition to the water, the preferred BPP solvent, the optional $H_2O_2$ and the surfactants disclosed above, liquid compositions used herein may comprise various optional ingredients, such as perfumes, preservatives, brighteners, salts for viscosity control, pH adjusters or buffers, and the like. The following illustrates preferred ranges for cleaning compositions for use herein, but is not intended to be limited thereof.

| Ingredient | % (wt.) Formula Range |
|---|---|
| BPP (Solvent) | 0.05–5 |
| Surfactant | 0–2 |
| Perfume | 0.01–1.5 |
| Water | Balance |

pH range from about 6 to about 8.

Other solvents or co-solvents which can optionally be used herein include various glycol ethers, including materials marketed under trademarks such as Carbitol, methyl Carbitol, butyl Carbitol, propyl Carbitol, and hexyl Cellosolve, and especially methoxy propoxy propanol (MPP), ethoxy propoxy propanol (EPP), propoxy propoxy propanol (PPP), and all isomers and mixtures, respectively, of MPP, EPP, and BPP, as well as butoxy propanol (BP), and the like, and mixtures thereof. If used, such solvents or co-solvents will typically comprise from about 0.5% to about 2.5%, by weight, of the aqueous compositions herein. Non-aqueous (less than 50% water) compositions which optionally can be used in the pre-spotting step, can comprise the same solvents.

Preferred compositions for use in the in-dryer cleaning/refreshment step of the process herein are as follows.

| Ingredient | % (wt.) | Range (% wt.) |
|---|---|---|
| Water | 99.0 | 95.1–99.9 |
| Perfume | 0.5 | 0.05–1.5 |
| Surfactant* | 0.5 | 0.05–2.0 |
| Ethanol or Isopropanol | 0 | Optional to 4% |
| Solvent (e.g. BPP) | 0 | Optional to 4% |

*Especially ethoxylated alcohols, as disclosed herein. The fabric refreshment compositions may also contain anionic surfactants. Such anionic surfactants are well-known in the detergency arts. Commercial surfactants available as TWEEN ®, SPAN ®, AEROSOL OT ®, and various sulfosuccinic esters are especially useful herein.

In addition, a variety of cleaning compositions disclosed in the patent literature, e.g. those cited above—WO 97/00993A1; WO 97/00990A2; GB 2,302,553A; GB 2,302,878A; and GB 2,302,879A can be used in the articles herein.

Perfume—It has been determined that higher molecular weight, high boiling point, malodorous chemicals tend to be retained on the fabrics, at least to some degree. These malodors can be overcome, or "masked", by perfumes. Accordingly, it will be appreciated that the perfumer should select at least some perfume chemicals which are sufficiently high boiling that they are not entirely lost during the process. A wide variety of aldehydes, ketones, esters, acetals, and the like, perfumery chemicals which have boiling points above about 50° C., preferably above about 85° C., are known. Such ingredients can be delivered to the fabrics being treated by means of the carrier substrate herein during the process herein, thereby helping to reduce the user's perception of malodors. Non-limiting examples of perfume materials with relatively high boiling compositions include various essential oils, resinoids, and resins from a variety of sources including but not limited to orange oil, lemon oil, patchouli, Peru balsam, Olibanum resinoid, styrax, labdanum resin, nutmeg, cassia oil, benzoin resin, coriander, lavandin and lavender. Still other perfume chemicals include phenyl ethyl alcohol, terpineol and mixed pine oil terpenes, linalool, linalyl acetate, geraniol, nerol, 2-(1,1-dimethylethyl)-cyclohexanol acetate, orange terpenes and eugenol. Of course, lower boiling materials can be included, with the understanding that some loss will occur due to venting.

Containment Bag—The compositions are loaded on the carrier substrate which is encased in the coversheet and the finished article is placed in a bag environment for use in a heated operating clothes dryer, or the like, to remove malodors from fabrics as a dry cleaning alternative or "fabric refreshment" process. The warm, humid environment created inside this bag volatilizes malodor components in the manner of a "steam distillation" process, and moistens fabrics and the soils thereon. This moistening of fabrics can loosen pre-set wrinkles, but it has now been discovered that overly wet fabrics can experience setting of new wrinkles during the drying stage toward the end of the dryer cycle. Proper selection of the amount of water used in the process and, importantly, proper venting of the bag in the present manner can minimize wrinkling. Moreover, if the bag is not vented, the volatilized malodorous materials removed from the fabrics can undesirably be re-deposited thereon.

Thus, in accordance with art-disclosed processes, the process herein can be conducted in a sealed bag. However, in a highly preferred mode, the process of the present inventing preferably employs a vapor-venting containment bag. The bag is preferably designed for multiple uses and reuses, and is especially adapted for use by the consumer in any conventional hot air clothes dryer apparatus, such as those found in the home or in commercial laundry/cleaning establishments. The bag is designed to vent water and other vapors (including malodorous materials) which emanate from within the bag when used in the manner described herein. The vapors released from the bag are thence exhausted through the air vent of the dryer apparatus.

As described more fully hereinafter, the preferred venting bag is provided with a vapor-venting closure which provides one or more gaps through which vapors are released from the bag, in-use. In a preferred embodiment, the size of this gap is selected to provide controlled vapor release from the bag under the indicated operating conditions. While other gap sizes and operating conditions can be used, a preferred balance between vapor containment within the bag to perform the cleaning/refreshment function and vapor release from the bag has now been determined using the principles disclosed hereinafter.

Alternatively, the bag can be provided with a series of holes or other fenestrations which provide vapor venting. However, such venting is not as effective as the vapor-venting closure.

In one mode, the present invention employs a vapor-venting containment bag comprising an open end, a closed end and flexible side walls having inner and outer surfaces, the open end of said bag having a section of one side wall extending beyond said open end to provide a flexible flap, said flap having first fastening device affixed thereto, said flap being foldable to extend over a portion of the outside surface of the opposing side wall, said flap being affixable to the outer surface of the opposing wall of the bag by engaging said first fastening device on the inside face of the flap with a second fastening device present on the outside face of said opposing side wall, said first and second fastening devices, when thus engaged, forming a fastener, thereby providing a closure for the open end of the bag. Said first and second fastening devices are disposed so as, when engaged, to provide vapor-venting along said closure, especially at the lateral edges of the closure. The bag herein is most preferably formed from film which is heat resistant up to at least about 204° C.–260° C. Nylon is a preferred film material for forming the bag. In another embodiment, the edge of one wall of the bag is notched along a substantial portion of its width to facilitate and optimize vapor venting.

In an alternate mode, the flap can be folded to provide the closure, tucked inside the opposing side wall, and secured there by a fastener. In this mode, vapors are vented along the closure and especially at the lateral edges of the closure. In yet another mode, the side walls are of the same size and no flap is provided. Fastening devices placed intermittently along portions of the inner surfaces of the side walls are engaged when the lips of the side walls are pressed together to provide closure. One or more vapor-venting gaps are formed in those regions of the closure where no fastening device is present.

While the fastening devices herein can comprise chemical adhesives, the bag is preferably designed for multiple uses. Accordingly, reusable mechanical fasteners are preferred for use herein. Any reusable mechanical fastener or fastening means can be used, as long as the elements of the fastener can be arranged so that, when the bag is closed and the fastener is engaged, a vapor-venting closure is provided. Non-limiting examples include: bags wherein said first and second fastening devices, together, comprise a hook and loop (VELCRO®-type) fastener; hook fasteners such as described in U.S. Pat. No. 5,058,247 to Thomas & Blaney issued Oct. 22, 1991; bags wherein said first and second fastening devices, together, comprise a hook and string type fastener; bags wherein said first and second fastener devices, together, comprise an adhesive fastener; bags wherein said first and second fastening devices, together, comprise a toggle-type fastener; bags wherein said first and second fastening devices, together, form a snap-type fastener; as well as hook and eye fasteners, ZIP LOK®-style fasteners, zipper-type fasteners, and the like, so long as the fasteners are situated so that vapor venting is achieved. Other fasteners can be employed, so long as the vapor-venting is maintained when the bag is closed, and the fastener is sufficiently robust that the flap does not open as the bag and its contents are being tumbled in the clothes dryer. The fastening devices can be situated that the multiple vapor-venting gaps are formed along the closure, or at the lateral edges, or so that the gap is offset to one end of the closure. In yet another embodiment, both ends of the bag are provided with a vapor venting closure. This type of bag is referred to in FIGS. 6, 7 and 8 as "Envelope Bag (2)".

Preferred bags of the foregoing type which are designed for use in a conventional U.S.-style automatic, in-home hot air clothes dryer will have a volume in the range from about 10,000 $cm^3$ to about 25,000 $cm^3$.

The invention also employs a process for cleaning or refreshing fabrics by contacting said fabrics with a fabric cleaning/refreshing composition comprising water in the aforesaid vapor-venting containment bag. This process is conveniently carried out in a hot air clothes dryer, or the like, at a dryer operating temperature from about 40° C. to about 150° C. whereby malodors present on said fabrics are vented from the bag by means of the vapor-venting closure.

The design of the venting ability of the bag achieves a proper balance of the above effects. A tightly-sealed, vapor impermeable "closed" bag will not purge malodors and will overly moisten the fabrics, resulting in wrinkling. An overly "open" bag design will not sufficiently moisten the fabrics or soils to mobilize heavier malodors or to remove pre-existing fabric wrinkles. Further, the bag must be "closed" enough to billow and create a void volume under water vapor pressure, wherein the fabrics can tumble freely within the bag and be exposed to the vapors.

The bag is designed with sufficient venting to trap a portion of water vapors (especially early in the dryer cycle) but to allow most of the water to escape by the end of the cycle. Said another way, the rate of vapor release is, preferably, optimized to secure a balance of vapor venting and vapor trapping. A preferred bag design employs a water vapor impermeable film such as nylon, with a the closure flap (preferably with a hook-and-loop VELCRO®-type fastener) like that of a large envelope. The degree of slack in the fold-over portion of the closure flap can be varied to provide a vapor-venting air gap or partial opening which controls the rate of vapor venting from of the bag. In another mode, a notch is cut along the edge of the side wall opposite the flap to further adjust the venting. The fastener devices shown in the Figures run only partly along the closure, thereby allowing venting to also occur at the lateral edges of the closure.

The following is intended to assist the formulator in the manufacture and use of vapor-venting bags in the manner of this invention, but is not intended to be limiting thereof.

Figure 4:
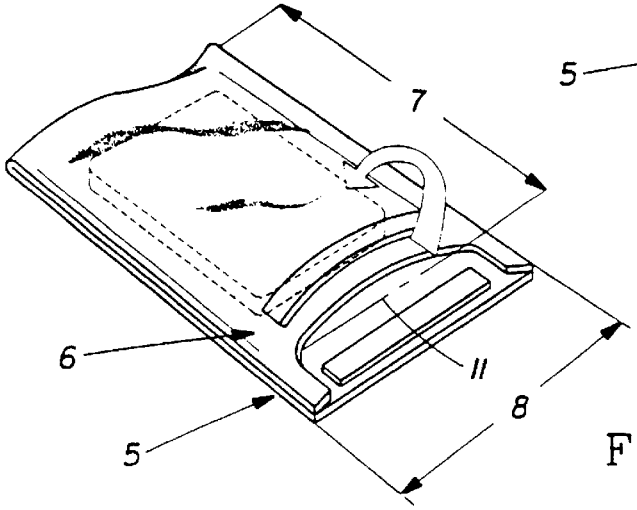
FIG. 4 is a perspective of the article within the bag which is ready to receive the fabrics to be treated in a hot air clothes dryer.

Bag Dimensions—FIG. 4 shows the overall dimensions of a notched bag; i.e., length (7) to fold line 27⅝ inches (70.2 cm); width (8) of bag 26 inches (66 cm), with a flap to the base of the fold line (11) of 2⅜ inches (6 cm). In the Tests reported hereinafter, this bag is referred to by its open dimensions as "26 in. ×30 in." (66.04 cm×76.20 cm).

Figure 5:
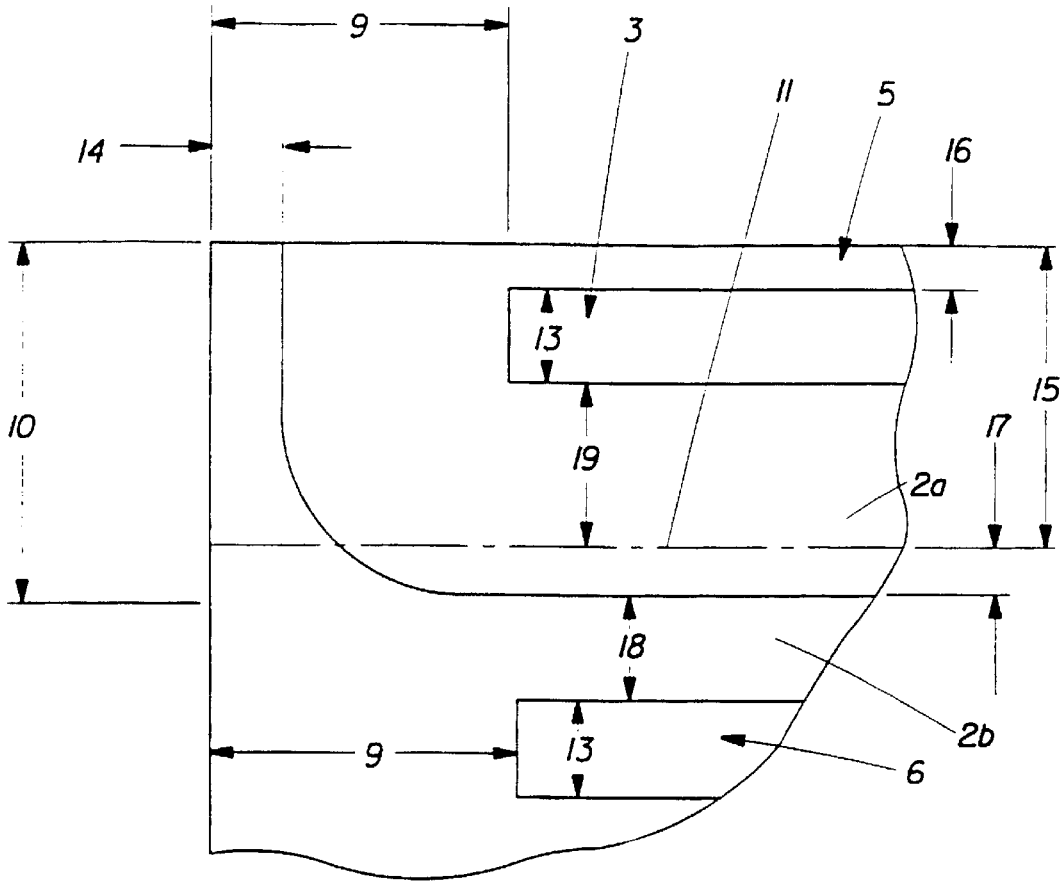
FIG. 5 is a partial view of the notched wall of the bag and its disposition relative to the closure flap.

FIG. 5 gives additional details of the positioning of the various elements of the notched bag. In this embodiment, all dimensions are the same for both the left hand and right hand sides of the bag. The dimensions herein are for an opened bag which is about 30 inches (76.2 cm) in overall length (including the flap) and about 26 inches (66 cm) wide. The distance (9) from the lateral edge of the bag to the outermost edge of the fastening device (3) located on the inside of the flap (5) is about 2 inches (5 cm). In this embodiment, the fastening device (3) on the inside of wall **(2*a*) comprises the loop portion of a VELCRO®-type strip whose width (13) is about 0.75 inches (1.9 cm) and whose total length is about 22 inches (55.9 cm). Fastening device (6) is similarly situated on the outside of wall 2(*b*) and comprises the hook portion of a ¾ inch (1.9 cm) VELCRO®-type strip. Distance (9) can be decreased or increased to decrease or increase venting at the edges of the flap when the bag is closed and the fastener is engaged. The distance (10) between the uppermost edge of the flap and the base of the notch is about 2⅞ inches (7.3 cm). The distance (14) between the lateral edge of the bag and the lateral edge of the notch is about 0.25 inches (0.64 cm). The distance (15) between the uppermost edge of the flap and the fold (11) is about 2⅜ inches (6 cm). The distance (16) between the uppermost edge of the flap and the leading edge of the VELCRO®-type strip (3) affixed to the flap is about ⅜ (0.95 cm). The distance (17) between fold (11) and the lowermost edge of the notch is about ½ inch (1.27 cm). This distance also can be varied to decrease or increase vapor venting. A range of 0.25–1.5 inches (0.64–3.81 cm) is typical. The distance (18) between the uppermost edge of the VELCRO®-type strip (6) and the bottom edge of the notch is about ¾ inches (1.9 cm). The distance (19) between the bottommost edge of the VELCRO®-type strip (3) and the fold (11)** is about 1¼ inches (3.17 cm).

Figure 6:
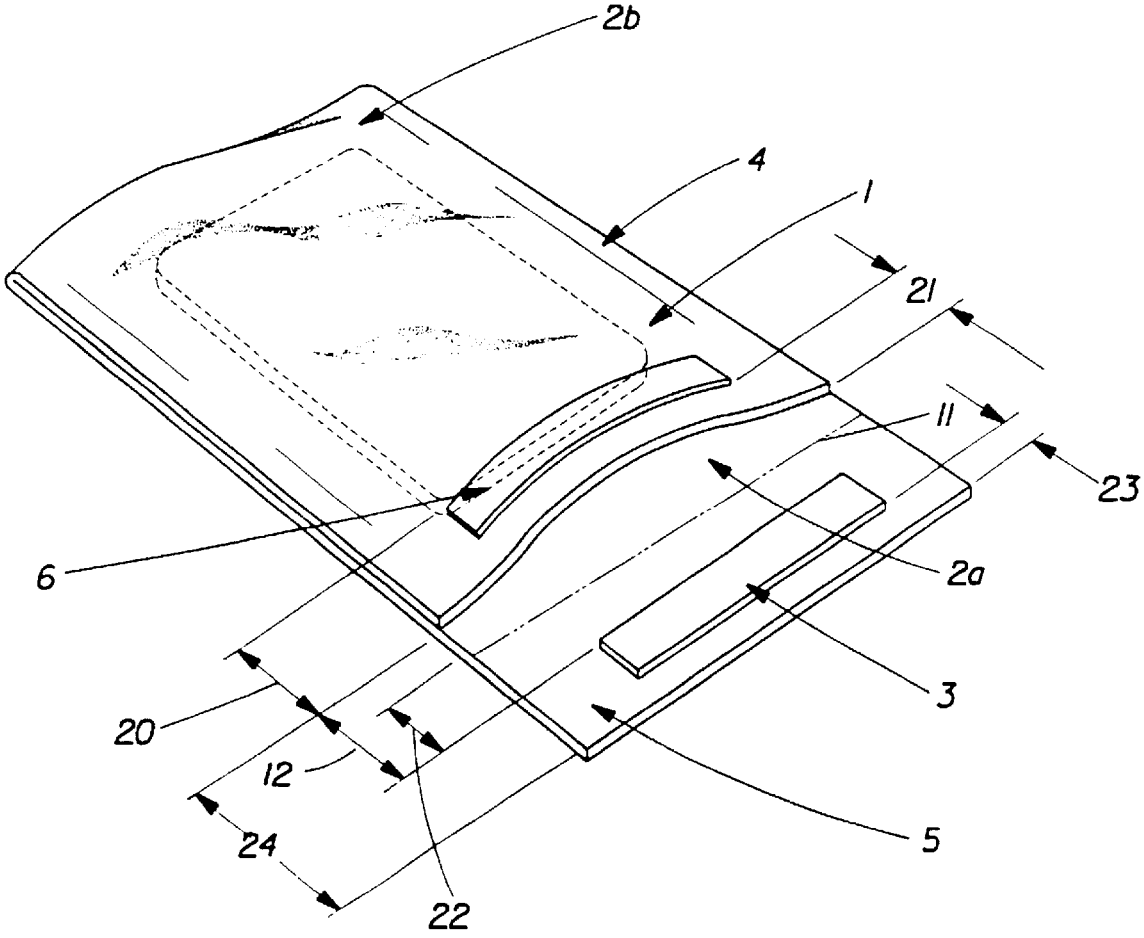
FIG. 6 is a perspective of an un-notched vapor-venting bag containing a loose cleaning/refreshment article of the present invention.

FIG. 6 gives additional details of the dimensions of an un-notched envelope bag of the forgoing overall size comprising sidewalls **(2*a*) and (2*b*). Again, each VELCRO®-type strip (3) and (6) is about ¾ inches (1.9 cm) in width and about 22 inches (55.9 cm) in length. Each strip is positioned so as to be inboard from each of the lateral edges of the finished bag wall and flap by about 2 inches (5 cm). The distance (12) between the leading edge of the sidewall (2*b*) to the base edge of the fastener strip (3) on the flap portion of the bag is about 2½ inches (6.35 cm). The distance (20) between the base edge of the fastener strip (6) to the leading edge of the sidewall (2*b*) is about 2.25 inches (5.7 cm). The distance (21) between the leading edge of the fastener strip (6) to the leading edge of the sidewall is about 1⅜ inches (3.5 cm). The distance (22) between fold (11) and the base edge of the fastener strip (3) is about 2 inches (5 cm). The distance (23) between the leading edge of fastener strip (3) and the uppermost edge of the flap which is an extension of sidewall (2*a*) is about 0.25 inches (0.64 cm). Distance (24)** is about 3⅝ inches (9.2 cm). As in the foregoing notched bag, the positioning and length of the fasteners can be adjusted to decrease or increase venting.

The construction of the preferred, heat resistant vapor-venting bag used herein to contain the fabrics in a hot air laundry dryer or similar device preferably employs thermal resistant films to provide the needed temperature resistance to internal self-sealing and external surface deformation sometimes caused by overheated clothes dryers. In addition, the bags are resistant to the chemical agents used in the cleaning or refreshment compositions herein. By proper selection of bag material, unacceptable results such as bag melting, melted holes in bags, and sealing of bag wall-to-wall are avoided. In a preferred mode, the fastener is also constructed of a thermal resistant material. As shown in FIGS. 4 and 6, in one embodiment, 1 to 3 mil (0.025–0.076 mm) heat-resistant Nylon-6 film is folded and sealed into a containment bag. Sealing can be done using standard impulse heating equipment. In an alternate mode, a sheet of nylon is simply folded in half and sealed along two of its edges. In yet another mode, bags can be made by air blowing operations. The method of assembling the bags can be varied, depending on the equipment available to the manufacturer and is not critical to the practice of the invention.

The dimensions of the containment bag can vary, depending on the intended end-use. For example, a relatively smaller bag can be provided which is sufficient to contain one or two silk blouses. Alternatively, a larger bag suitable for handling a man's suit can be provided. Typically, the bags herein will have an internal volume of from about 10,000 $cm^3$ to about 25,000 $cm^3$. Bags in this size range are sufficient to accommodate a reasonable load of fabrics (e.g., 0.2–5 kg) without being so large as to block dryer vents in most U.S.-style home dryers. Somewhat smaller bags may be used in relatively smaller European and Japanese dryers.

The bag herein is preferably flexible, yet is preferably durable enough to withstand multiple uses. The bag also preferably has sufficient stiffness that it can billow, in-use, thereby allowing its contents to tumble freely within the bag during use. Typically, such bags are prepared from 0.025 mm to 0.076 mm (1–3 mil) thickness polymer sheets. If more rigidity in the bag is desired, somewhat thicker sheets can be used.

In addition to thermally stable "nylon-only" bags, the containment bags herein can also be prepared using sheets of co-extruded nylon and/or polyester or nylon and/or polyester out and/or inner layers surrounding a less thermally suitable inner core such as polypropylene. In an alternate mode, a bag is constructed using a nonwoven outer "shell" comprising a heat-resistant material such as nylon or polethylene terephthalate and an inner sheet of a polymer which provides a vapor barrier. The non-woven outer shell protects the bag from melting and provides an improved tactile impression to the user. Whatever the construction, the objective is to protect the bag's integrity under conditions of thermal stress at temperatures up to at least about 400–500° F. (204° C. to 260° C.). Under circumstances where excessive heating is not of concern, the bag can be made of polyester, polypropylene or any convenient polymer material.

Vapor Venting Evaluation—In its broadest sense, the preferred vapor-venting containment bag used herein is designed to be able to vent at least about 40%, preferably at least about 60%, up to about 90%, preferably no more than about 80%, by weight, of the total moisture introduced into the bag within the operating cycle of the clothes dryer or other hot air apparatus used in the process herein. (Of course most, if not all, of organic cleaning solvents, if any, will also be vented during together with the water. However, since water comprises by far the major portion of the cleaning/refreshment compositions herein, it is more convenient to measure and report the venting as water vapor venting.)

It will be appreciated by those knowledgeable about the operation of hot air clothes dryers and similar apparatus that the rate of venting will usually not be constant over the entire operating cycle. All dryers have a warm-up period at the beginning of the operating cycle, and this can vary according to the specifications of the manufacturer. Most dryers have a cool-down period at the end of the operating cycle. Some venting from the containment bag can occur during these warm-up and cool-down periods, but its rate is generally less than the venting rate over the main period of the drying cycle. Moreover, even during the main period of the cycle, many modern dryers are constructed with thermostat settings which cause the air temperature in the dryer to be increased and decreased periodically, thereby preventing overheating. Thus, an average, rather than constant, dryer operating temperature in the target range of from about 50° C. to about 85° C. is typically achieved.

Moreover, the user of the present containment bag may choose to stop the operation of the drying apparatus before the cycle has been completed. Some users may wish to secure fabrics which are still slightly damp so that they can be readily ironed, hung up to dry, or subjected to other finishing operations.

Apart from the time period employed, the Vapor-Venting Equilibrium ("VVE") for any given type of vapor-venting closure will depend mainly on the temperature achieved within the dryer—which, as noted above, is typically reported as an average "dryer air temperature". In point of fact, the temperature reached within the containment bag is more significant in this respect, but can be difficult to measure with accuracy. Since the heat transmittal through the walls of the bag is rather efficient due to the thinness of the walls and the tumbling action afforded by conventional clothes dryers, it is a reasonable approximation to measure the VVE with reference to the average dryer air temperature.

Moreover, it will be appreciated that the vapor-venting from the containment bag should not be so rapid that the aqueous cleaning/refreshment compositions does not have the opportunity to moisten the fabrics being treated and to mobilize and remove the soils/malodors therefrom. However, this is not of practical concern herein, inasmuch as the delivery of the composition from its carrier substrate onto the fabrics afforded by the tumbling action of the apparatus occurs at such a rate that premature loss of the composition by premature vaporization and venting is not a significant factor. Indeed, the preferred bag herein is designed to prevent such premature venting, thereby allowing the liquid and vapors of the cleaning/refreshment compositions to remain within the bag for a period which is sufficiently long to perform its intended functions on the fabrics being treated.

The following Vapor-Venting Evaluation Test (VVET) illustrates the foregoing points in more detail. Large or smaller containment bags can be used, depending on the volume of the dryer drum, the size of the fabric load, and the like. As noted above, however, in each instance the containment bag is designed to achieve a degree of venting, or VVE "score", of at least about 40% (40 VVE), preferably at least about 60% (60 VVE), up to about 90% (90 VVE).

VAPOR-VENTING EVALUATION TEST

Materials

Envelope or "Standard", i.e., Control Containment Bag to be evaluated for VVE.

Carrier Substrate (15"×11":38.1 cm×27.9 cm) HYDRASPUN® carrier substrate sheet from Dexter with (10444) or without (10244) Binder Wool Blouse: RN77390, Style 12288, Weight approx. 224 grams Silk Blouse: RN40787, Style 0161, Weight approx. 81 grams Rayon Swatch: 45"×17"(114.3 cm×43.2 cm), Weight approx. 60 grams Pouch: 5"×6.375"(12.7 cm×16.2 cm) to contain the Carrier Substrate and water De-ionized Water; Weight is variable to establish VVE.

Pretreatment of Fabrics

1. The wool, silk, and rayon materials are placed in a Whirlpool dryer (Model LEC7646DQO) for 10 minutes at high heat setting, with the heating cycle ranging from about 140° F.–165° F. to remove moisture picked up at ambient condition.
2. The fabrics are then removed from the dryer and placed in sealed nylon or plastic bags (minimum 3 mil. thickness) to minimize moisture pick up from the atmosphere.

Test Procedure

1. Water of various measured weights from 0 to about 40 grams is applied to the carrier substrate a minimum of 30 minutes before running a vented bag test. The substrate is folded, placed in a pouch and sealed.
2. Each fabric is weighed separately and the dry weights are recorded. Weights are also recorded for the dry carrier substrate, the dry pouch containing the substrate, and the dry containment bag being evaluated.
3. Each garment is placed in the bag being evaluated for vapor venting along with the water-containing substrate (removed from its pouch and unfolded).
4. The bag is closed without expressing the air and placed in the Whirlpool Dryer for 30 minutes at the high heat setting, with tumbling per the standard mode of operation of the dryer.
5. At the end of 30 minutes the bag is removed from the dryer and each fabric, the carrier substrate, the bag and the pouch are weighed for water weight gain relative to the dry state. (A possible minor loss in weight for the containment bag due to dryer heat is ignored in the calculations.)
6. The weight gain of each garment is recorded as a percent of the total moisture applied to the carrier substrate.
7. The remaining unmeasured moisture divided by the total moisture is recorded as percent vented from the dryer bag.
8. When a series of total applied moisture levels are evaluated, it is seen that above about 15–20 grams of water the % vented becomes essentially constant, and this is the Vapor-Venting Equilibrium value, or VVE, for the particular bag venting design.

It can be seen from examining a series of VVET results at various initial moisture levels that the water at lower initial levels is being disproportionately captured by the garment load, the headspace, and the nylon bag, such that venting of water and volatile malodors begins in earnest only after the VVE value is achieved. Since this occurs only when about 15–20 grams or more of water is initially charged, it is seen that a VVE of greater than about 40 is needed to avoid excessive wetting of garments, leading to unacceptable wet-setting of wrinkles, as discussed herein.

Malodor and Wrinkle Removal

The overall process herein optionally comprises a spot removal step on isolated, heavily stained areas of the fabric. Following this localized stain removal step, the entire fabric can be cleaned/refreshed in the vapor-venting containment bag. This latter step provides a marked improvement in the overall appearance and refreshment of fabrics, especially with respect to the near absence of malodors and wrinkles, as compared with untreated fabrics.

One assessment of this step of the process using the vapor-venting bag herein with respect to malodors comprises exposing the fabrics to be tested to an atmosphere which contains substantial amounts of cigarette smoke. In an alternate mode, or in conjunction with the smoke, the fabrics can be exposed to the chemical components of synthetic perspiration, such as the composition available from IFF, Inc. Expert olfactory panelists are then used to judge odor on any convenient scale. For example, a scale of 0 (no detectable odor) to 10 (heavy malodor) can be established and used for grading purposes. The establishment of such tests is a matter of routine, and various other protocols can be devised according to the desires of the formulator.

For example, garments to be "smoked" are hung on clothing hangers in a fume hood where air flow has been turned off and vents blocked. Six cigarettes with filters removed are lighted and set in ashtrays below the garments. The hood is closed and left until the cigarettes have about half burned. The garments are then turned 180° to get even distribution of smoke on all surfaces. Smoking is then continued until all cigarettes are consumed. The garments are then enclosed in sealed plastic bags and allowed to sit overnight.

After aging for about one day, the garments are treated in the cleaning/refreshment process using the venting bag. The garments are removed promptly from the containment bag when the dryer cycle is finished, and are graded for malodor intensity. The grading is done by an expert panel, usually two, of trained odor and perfume graders. The malodor intensity is given a grade of 0 to 10, where 10 is full initial intensity and 0 is no malodor detected. A grade of 1 is a trace detection of malodor, and this grade is regarded as acceptably low malodor in most users.

In the absence of perfume ingredients in the cleaning cloth composition, the grading of residual malodor intensity is a direct indication of degree of cleaning or removal of malodorous chemicals. When perfumed compositions are used, the grading panelists can also determine a score for perfume intensity and character (again on a 0 to 10 scale), and the malodor intensity grading in this case would indicate the ability of the residual perfume to cover any remaining malodorous chemicals, as well as their reduction or removal.

After the garment odor grading taken promptly after the cleaning/refreshment process, the garments are hung in an open room for one hour and graded again. This one-hour reading allows for an end-effect evaluation that would follow cool-down by the garments and drying of the moisture gained in the dryer cycle treatment. The initial out-of-bag grading does reflect damp-cloth odors and a higher intensity of warm volatiles from the bag, and these are not factors in the one-hour grades. Further garment grading can be done at 24 hours and, optionally, at selected later times, as test needs dictate.

Likewise, fabric wrinkles can be visually assessed by skilled graders. For example, silk fabric, which wrinkles rather easily, can be used to visually assess the degree of wrinkle-removal achieved by the present processes using the vapor-venting bag. Other single or multiple fabrics can optionally be used. A laboratory test is as follows.

DE-WRINKLING TEST

MATERIALS:

As above for VVET.

De-ionized Water. Weight range (0–38 grams)

Pretreatment of Fabrics:

The silk fabric is placed in a hamper, basket, or drum to simulate normal conditions that are observed after wearing. These storage conditions produce garments that are severely wrinkled (well defined creases) and require a moist environment to relax the wrinkles.

TEST PROCEDURE:

1. One silk fabric is placed in a containment bag being tested.
2. Water (0–38 grams) is applied to the carrier substrate a minimum of 30 minutes before running the test, placed in a pouch and sealed.
3. The silk garment is placed in the test containment bag along with the water-containing substrate (removed from its pouch and unfolded).
4. The bag is closed and placed in a Whirlpool Dryer (Model LEC7646DQO) for 30 minutes at high heat (48–74 C. cycle).
5. At the end of 30 minutes, the dryer bag is removed from the dryer IMMEDIATELY and the silk garment is placed on a hanger.
6. The silk garment is then visually graded versus the Control Garment from the same Pretreatment Of Fabrics.

In laboratory tests of the foregoing type, the in-dryer, non-immersion cleaning/refreshment processes herein typically provide malodor (cigarette smoke and/or perspiration) malodor grades in the 0–1 range for smoke and somewhat higher for perspiration malodors, thereby indicating good removal of malodor components other than those of sufficiently high molecular weights that they do not readily "steam vaporize" from the fabrics. Likewise, fabrics (silks) have wrinkles removed to a sufficient extent that they are judged to be reasonably suitable for wearing with little, or no, ironing.

Cleaning Device

Figure 7:
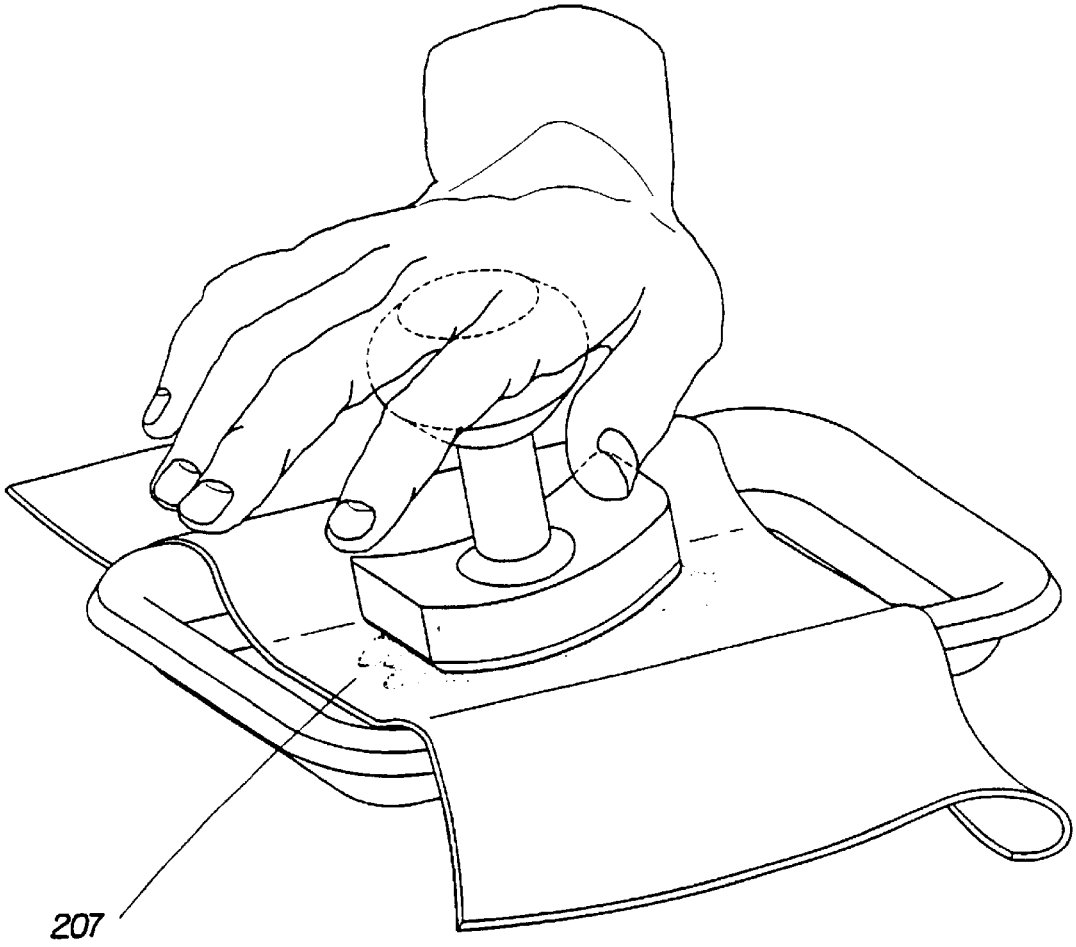
FIG. 7 illustrates use of an arcuate, convex cleaning base to spot treat localized fabric stains (207) using hand pressure prior to treatment of the fabric with the article of this invention. In this illustration, a holding tray is shown beneath the fabric being treated, but any hard surface such as a table top is suitable. In a preferred mode, an absorbent stain receiver is placed directly beneath the stained area of fabric being treated.

As shown in FIG. 7, one style of preferred cleaning device employed in the optional spot-cleaning step of the present process has as its base element a cleaning face which is curvilinear, i.e., which is in a generally convex, arcuate configuration. In another embodiment, the device can have a circular, convex base. Overall, the arcuate device is reminiscent of an old-fashioned, flat-sided, arcuate desk blotting instrument, but with multiple protrusions, e.g., bristles or bristle-like filaments, extending outwardly from its operational face. The arcuate, convex configuration of the treatment face of the device herein provides several advantages over convex, circular cleaning devices. First, the arcuate configuration efficiently and effectively allows downward (Z-directional) force to be applied to localized stained areas of the fabric. Second, the convex (especially arcuate) configuration dissuades the user from disadvantageously employing a side-to-side (X–Y direction) rubbing motion with the device. This avoids fiber/fabric damage which can result from a side-to-side "scrubbing" (X–Y plane) action. Third, the preferred arcuate type of cleaning element, with its plurality of protuberances, is easier to apply and adhere to the arcuate, convex device than to a circular, convex device. This is because the element can be laid-down more readily on the convex surface of the arcuate device and, thus, can more easily be affixed thereto by gluing or other means. Accordingly, the convex, arcuate device herein is superior to the convex, circular device with respect to its ease of manufacture on a commercial scale. However, either type of device can be used in the pre-spotting step of the process herein.

The rear face of the device can be of any configuration, e.g., concave, convex, planar, arched, etc., to provide a means for gripping the device in the hand. In a preferred embodiment shown in FIG. 7, the hand grip comprises a shaft extending outwardly from the rear face of said base member, preferably from the center of the rear face, and most preferably wherein said shaft is substantially perpendicular to the rear face. For ease-of-handling, the distal end of the shaft preferably terminates in a bulb which is of a size that fits in the user's hand.

By employing a hand grip in the form of a shaft which is substantially perpendicular to the operational convex base member, the user is further encouraged to use the device in the desired rocking motion, rather than in a scrubbing motion, which would be unhandy due to the perpendicularity of the shaft relating to the operational arcuate treatment face of the device. Thus, the overall configuration of the device, with its convex base and gripping shaft, immediately encourages proper use of the device. Optionally, simple operating instructions, such as "Rock, Don't Rub" can be affixed to the device as a reminder.

In one embodiment, the working face of the device comprises a multiplicity of "protrusions" or "protuberances", e.g., knobs, fibers or bristle-like filaments or like structures as "treatment members" which extend outwardly from the surface of the treatment device. Such members come into contact with the fabric being spot-cleaned ("pre-spotted") to provide mechanical cleaning action. Preferably, said treatment members are underlaid by a resilient sponge base which is affixed to the convex face of the arcuate base member. This resilient base also acts as a cushion to buffer the impact of the bristles on the surface of the fabric, thereby further helping to minimize deleterious effects on the fabric surface and more evenly distributing the mechanical forces.

Such cleaning devices can be of any desired size. The device as shown in FIG. 7 is of a size which is convenient for hand-held use. In this embodiment, the length of the arcuate base member with its convex, generally rectangular configuration is about 2.25 inches (57.15 mm); its width is about 1.25 inches (31.75 mm); and its thickness is about 0.625 inch (15.8 mm). The length of the cylindrical shaft extending perpendicularly outward from the rear of the arcuate base to the base of bulb is about 1.4 inches (35.6 mm), and its diameter is about 0.75 inches (19 mm). The bulb which serves as a hand (or palm) rest at the terminal end of the shaft was a circumference at its widest point of about 5.25 inches (133 mm). The combination of shaft and bulb thus comprises the hand grip for the device. The overall heights of the device measured from the center of the top of the bulb to the center point of the front face of the convex base is about 2⅞inches (7.3 cm). The uncompressed thickness of the sponge layer which underlies the protrusions on the working face can vary, and is typically about 0.1 inches (2.54 mm). The uncompressed thickness of the layer of filamentous protrusions can likewise vary and is typically about 0.1 inches (2.54 mm).

An alternative embodiment of the arcaute device shown in FIG. 7, the length of the arcuate base member with its convex, generally rectangular configuration is about 2 inches (5 cm); its width is about 1.25 inches (3.2 cm); and its thickness is about 5/16 inch (0.8 cm). The width of shaft at its mid-point is about 1 inch (2.54 cm) and its thickness at its midpoint is about 0.75 inch (1.9 cm). The length of the shaft extending perpendicularly outward from the rear of the arcuate base to the base of bulb is about 1.25 inches (3.2 cm). The bulb which serves as a hand (or palm) rest has a circumference at its widest point of about 5.75 inches (14.6 cm). The combination of shaft and bulb thus comprise the hand grip for the device. The overall height of the device measured from the center of the top of the bulb to the center point of the front face of the convex base is about 3 inches (7.6 cm). The dimensions of the sponge layer and protuberances are as given above.

The convex base, shaft and palm rest of the fabric cleaning devices for use in the pre-spotting operation of the overall process herein can be manufactured by injection molding or other suitable processes using polymers such as low-and high-density polyethylene, polypropylene, nylon-6, nylon-6.6, acrylics, acetals, polystyrene, polyvinyl chloride, and the like. High density polyethylene and polypropylene are within this range and are preferred for use herein. Brightener-free materials are preferably used.

The treatment members on the devices herein can comprise natural or synthetic bristles, natural or synthetic sponges, absorbent pads such as cotton, rayon, regenerated cellulose, and the like, as well as the HYDRASPUN® fabric described herein, and combinations thereof. Various useful materials are all well-known in the cleaning arts in conventional brushes and toothbrushes (see U.S. Pat. No. 4,637,660) and in various cleaning utensils. Sponges, pads, and the like can typically have a thickness of from about 1 mm to about 1.25 cm and can be glued to the convex front treatment face of the device. Preferably, the sponges, pads, bristled pads, etc., are brightener-free and are typically co-extensive with substantially the entire treatment face.

The protuberances which project outwardly from the treatment face of the base of the device can be in the form of blunt or rounded bristles, which may be provided uniformly across the entire treatment face of in clusters. The protuberances can be in the form of monofilament loops, which can be circular, ovoid or elongated, or can be cut loops. The protuberances can comprise twisted fiber bundles, extruded nubs, molded finger-like appendages, animal hair, reticulated foams, rugosities molded into the face of the member, and the like. Protuberances made from monofilament fibers may be straight, twisted or kinked. Again, these are preferable brightener-free.

In one embodiment, the treatment member can comprise multiple components. In particular, the treatment member can comprise an absorbent base material which can be, for example, a natural or synthetic sponge, an absorbent cellulosic sheet or pad, or the like. In contact with and extending outward from this base material are multiple protrusions as disclosed above. A specific example of this embodiment is a treatment member comprising multiple looped protuberances made from monofilament fibers which protrude from a sponge base layer. In this embodiment, the absorbent base layer can act as a reservoir which feeds the spot cleaning composition to the protuberances and thence onto the fabrics being treated.

In various optional modes, the treatment members present on the convex face of the device herein can comprise a multi-layer composite comprising a sponge-like, resilient backing material for a fibrous layer having multiple-fibrous elements extending outwardly therefrom. Such composites can be permanently or semi-permanently affixed to the treatment members using glue, pressure sensitive adhesives, or other conventional means, and, typically, are also substantially co-extensive with the entire arcuate face of the device. Such composites can be made from conventional materials, e.g., using a sponge, foam or other absorbent base pad material from about 0.5–20 mm thickness and a layer of fibers such as a conventional painter's pad with fibers having a length of from about 0.05 mm to about 20 mm.

The protuberances herein are typically provided as a bed or mat which comprises multiple strands or loops which extend therefrom in the Z-direction. Convenient and familiar sources include pile carpet-type materials, paint pad-type materials, and the like. In such embodiments, the treatment member will comprise several thousand protuberances per $cm^2$. With the looped protuberances, there will typically be 10–500, preferably about 60–150, loops per $cm^2$. The choice of the source, style and number of protuberances are matters for the manufacturer's discretion, and the foregoing illustrations are not intended to be limiting of the invention.

The protuberances should preferably extend outwardly from the face of the treatment member for a distance of at least about 0.1 mm, preferably about 0.1 inches (2.54 mm). While there is no upper limit to their length, there is essentially no functional reason for the protuberances to extend more than about 1.25 cm.

The protuberances can be made from plastic, rubber or any other convenient, resilient material which is stable in the presence of the cleaning composition. Fibrous protrusions can be made from natural or synthetic fibers. Fiber diameters can typically range from 0.1 mil (0.0025 mm) to 20 mil (0.5 mm). Again, this is a matter of selection and is not intended to be limiting.

A preferred embodiment comprises a sponge layer of about 1.5 mm to about 7.0 mm thickness having a plurality of fibrous protrusions extending outwardly therefrom, said protrusions comprising brightener-free nylon 6,6 fibers having a length of about 0.10 inches (2.54 mm) and a denier of about 45+, i.e., about 2.7 mil (ca. 76 micrometers). Such fibers can be adhered to the sponge base using flocking or other techniques.

In another embodiment, the protuberances are in the form of a multiplicity of stiffened, ovoid looped fibers which extend outwardly from the treatment face. Such looped fibers can comprise, for example, 7 mil 0.18 mm) monofilament loops of polypropylene extending at least about 0.03 inch (0.76 mm), typically from about 2.0 mm to about 1.5 cm, outwardly from the face of a backing material. The diameter of the loops at their widest point is about 1.3 mm. A convenient material for said looped protrusions is available commercially from Aplix Inc., Number 200, Unshaved Loop, Part No. DM32M000-QY. This material comprises a nylon backing with about 420 loops per square inch (65 loops per $cm^2$) extending from its surface.

It will be appreciated that the devices herein can be made from a variety of plastic, glass, wood, etc. materials and with various overall shapes, decorations and the like, according to the desires of the manufacturer. If desired, the device can be prepared from transparent or translucent materials. This can be helpful under circumstances where the device is hollow and provides a reservoir for the pre-spotting composition, since the user can visually judge the "fill" level. Of course, the devices are preferably made from materials which will not be affected by the various ingredients used in the cleaning compositions. The size of the devices is entirely optional. It is contemplated that rather large devices (e.g. 200–100 $cm^2$ convex treatment face) would be suitable for mounting and use in a commercial cleaning establishment. In the home, the device is intended for hand-held use, and its dimensions are generally somewhat smaller. Typically, the surface area of the convex treatment face for home use will be in the range of from about 4 $cm^2$ to about 200 $cm^2$. This is variable, according to the desires of the manufacturer.

While the surface area of the treatment members can be adjusted according to the desires of the manufacturer, it is convenient for a hand-held, home-use device to have a treatment face whose surface area is in the range from about 5 $cm^2$ to about 70 $cm^2$.

Stain Receiver

A stain receiver can optionally be used in the optional pre-spotting operation herein. Such stain receiver can be any absorbent material which imbibes the liquid composition used in the pre-spotting operation. Disposable paper towels, cloth towels such as BOUNTY™ brand towels, clean rags, etc., can be used. However, in a preferred mode the stain receiver is designed specifically to "wick" or "draw" the liquid compositions away from the stained area One preferred type of receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils (1.524 mm) thick. It optionally, but preferably, has a barrier film on its rear surface to prevent the cleaning liquid from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer. The lower capillary suction comes from having greater synthetic staple fiber content in the upper layer (these fibers have surfaces with higher contact angles, and correspondingly lower affinity for water, than wood pulp fibers) than in the lower layer.

More particularly, the absorbent stain receiver article herein can be conveniently manufactured using procedures known in the art for manufacturing nonwoven, thermally bonded air laid structures ("TBAL"). As an overall proposition, TBAL manufacturing processes typically comprise laying-down a web of absorbent fibers, such as relatively short (4–5 mm) wood pulp fibers, in which are commingled relatively long (30–50 mm) bi-component fibers which melt slightly with the application of heat to achieve thermal bonding. The bi-component fibers intermingled throughout the wood pulp fibers thereby act to "glue" the entire mat together. Different from conventional TBAL-type structures, the disposition of the bi-component fibers in the upper and lower layers of the stain receiver herein is not uniform. Rather, the upper (fluid receiving) layer of the fibers which comprises the stain receiver is relatively richer in bi-component fibers than in wood pulp (or other cellulosic) fibers. Since the bi-component fibers are made from synthetic polymers which are relatively hydrophobic, the upper layer of fibers in the stain receiver tends to be more hydrophobic, as compared with the lower layer of fibers which, since it contains a high proportion of wood pump, tends to be more hydrophilic. This difference in hydrophobicity/phydrophilicity between the upper and lower fiber layers in the stain receiver helps draw water (e.g., the aqueous compositions herein) and stain materials out of the fabrics which are being treated in the manner disclosed herein.

To illustrate the foregoing in more detail, in one mode, the present stain receiver the uppermost (fluid receiving) layer (to be placed against the soiled garment) is about 50% bicomponent fiber and about 50% wood pulp, by weight, with a basis weight of about 50 grams/$m^2$ (gsm). The lower layer is an 80/20 (wt.) blend of wood pulp and bicomponent staple fiber with a basis weight of about 150 gsm. These ratios can be varied, as long as the upper layer is more hydrophobic than the lower layer. For example, upper layers of 60/40, 70/30, etc. bicomponent/wood can be used. Lower layers of 90/10 ,65/35, 70/30, etc. wood/bicomponent can be used.

Lint Control Binder Spray

A heat crosslinkable latex binder can optionally be sprayed onto the upper layer of the stain receiver article to help control lint and to increase strength. A variety of alternative resins may be used for this purpose. Thus, the surface of the uppermost layer can be sprayed with a crosslinkable latex binder (Airflex 124, supplied by Air Products) at a concentration of about 3 to 6 grams per square meter. This binder does not have great affinity for water relative to wood pulp, and thus does not importantly affect the relative hydrophobicity of the upper layer. Cold or hot crimping, sonic bonding, heat bonding and/or stitching may also be used along all edges of the receiver to further reduce linting tendency.

Backing Sheet

When thus prepared, the bi-layer absorbent structure which comprises the stain receiver is sufficiently robust that it can be used as-is. However, in order to prevent strike-through of the liquid onto the table top or other treatment surface selected by the user, it is preferred to affix a fluid-impermeable barrier sheet to the bottom-most surface of the lower layer. This backing sheet also improves the integrity of the overall stain receiver article. The bottom-most surface of the lower layer can be extrusion coated with an 0.5–2.0 mil (0.013 mm–0.05 mm), preferable 0.75 mil (0.019 mm), layer of PE or PP film using conventional procedures. The film layer is designed to be a pinhole-free barrier to prevent any undesired leakage of the liquid composition beyond the receiver. This backing sheet can be printed with usage instructions, embossed and/or decorated, according to the desires of the formulator. The stain receiver is intended for use outside the dryer. However, since the receiver may inadvertently be placed in the dryer and subjected to high temperatures, it is preferred that the backing sheet be made of a heat resistant film such as polypropylene or nylon.

Basis weight

This can vary depending on the amount of cleaning/refreshment solution provided/anticipated to be absorbed. The preferred stain receiver structure exhibits a horizontal absorbency of about 4–15 grams of water for every gram of nonwoven. A typical 90 mm ×140 mm receiver absorbs about 10–20 grams of water. Since very little fluid is used in the typical stain removal process, much less capacity is actually required. A practical basis weight range is therefore about 10 g, to about 50 g.

Size

The size of the preferred receiver is about 90 mm by 140 mm, but other sizes can be used. The shape can be varied.

Fibers

Conveniently available 2–3 denier (0.0075–0.021 mm) polyethylene/polypropylene PE/PP bicomponent staple and standard wood pulp (hammermilled) fibers are used in constructing the preferred receiver. Other common staple fibers such as polyester, acrylic, nylon, and bicomponents of these can be employed as the synthetic component. Again, capillary suction requirements need to be considered when selecting these fibers and their sizes or deniers. Larger denier detracts from capillary suction as does surface hydrophobicity. The absorbent wood pulp fiber can also be substituted with cotton, hemp, rayon, and others. If desired, the lower layer can also comprise the so-called "supersorber" absorbent gelling materials (AGM) which are known for use in the diaper and catamenial arts. Such AGM's can comprise 1% to 20%, by weight, of the lower layer.

Thickness

The overall thickness (measured unrestrained) of the stain receiver is about 60 mils (1.524 mm), but can be varied widely. The low end may be limited by the desire to provide absorbency impression. 25 mils to 200 mils (0.6 mm–5.1 mm) is a reasonable range.

Capillary suction/density

The overall density of the stain receiver affects both absorbency rate and fluid capacity. Typical wood pulp containing absorbent articles have a density (measured unrestrained) that ranges around 0.12–0.15 g/cc+/−0.05. The preferred bi-layer stain receiver herein also has a density in the same range, but can be adjusted outside this range. Higher density increases stiffness; lower density decreases overall strength and makes linting more probable. The capillary suction is determined by the type of fibers, the size of the fibers, and the density of the structure. Fabrics come in many varieties, and will exhibit a large range of capillary suction, themselves. It is desirable to construct a receiver that has a greater surface capillary suction than that of the stained garment being treated.

Colors

White is the preferred color, as it will best show stains as they are being removed from the fabrics being treated. However, there is no other functional limit to the color.

Embossing

The preferred stain receiver structure is embossable with any desired pattern or logo.

Optional Nonwoven (NW) types

While the TBAL stain receiver structure is preferred to permit density control, good thickness perception, good absorbency, and good resiliency, other types of NWs that can reasonably be used are hydroentangled, carded thermal, calendar-bonded, and other good wipe substrate-making processes (including thermal bonded wet-laid, and others).

Manufacture

The manufacture of the referred bi-layer stain receiver is conducted using conventional TBAL processes. In one mode, the lower wood fiber-rich layer is first laid-down and the upper, synthetic fiber-rich layer is laid-down on top of it. The optional binder spray is applied to the upper layer at any convenient time. The resulting bi-layer structure is collected in rolls (which compacts the overall structure somewhat). Overall, the bi-layer structure (unrestrained) has a thickness of about 60 mils and a density of about 0.13–0.15 g/cc. This density may vary slightly, depending on the usage rates of the binder spray. The optional backing sheet is applied by passing the structure in sheet form through nip-rollers, together with a sheet of the backing film. Again, conventional procedures are used. If desired, and as a cost savings, the relative thicknesses of the lower and upper layers can be varied. Thus, since wood pulp is less expensive than bi-component fibers, the manufacturer may decide to lay down a relatively thicker lower layer, and a relatively thinner upper layer. Thus, rather than a structure whose upper/lower layer thickness ratio is about 1:1, one can select ranges of 0.2:1, 0.3:1, 0.5:1, and the like. If more absorbency is required, the ratios can be reversed. Such considerations are within the discretion of the manufacturer.

The bi-layer stain receiver is intended to be made so inexpensively that it can be discarded after a single use. However, the structures are sufficiently robust that multiple re-uses are possible. In any event, the user should position the article such that "clean" areas are positioned under the stained areas of the fabric being treated in order to avoid release of old stains from the stain receiver back onto the fabric.

Another highly preferred type of stain receiver for use herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

For pre-spotting, the stained area of the garment or fabric swatch is placed over a section of FAM, followed by treatment with an aqueous or non-aqueous cleaning solution in conjunction with the use of the cleaning device herein to provide mechanical agitation. Repeated rocking with the device and the detergency effect of the solution serve to loosen the soil and transfer it to the FAM. While spot cleaning progresses, the suction effects of the FAM capillaries cause the cleaning solution and stain debris to be carried into the FAM, where the stain debris is largely retained. At the end of this step the stain as well as almost all of the cleaning solution is found to have been removed from the fabric being treated and transferred to the FAM. This leaves the fabric surface only damp, with a minimum residue of the cleaning solution/stain debris which can lead to undesirable rings on the fabrics.

The manufacture of FAM-type foams for use as the stain receiver herein forms no part of the present invention. The manufacture of FAM foam is very extensively describe din the patent literature; see, for example: U.S. Pat. No. 5,260,345 to DesMarais, Stone, Thompson, Young, LaVon and Dyer, issued Nov. 9, 1993; U.S. Pat. No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat No. 5,352,711 to DesMarais, issued Oct. 4, 1994; PCT application Ser. No. 93/04115 published Mar. 4, 1993, and U.S. Pat. No. 5,292,277 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; U.S. Pat. No. 5,550,167 to DesMarais, issued Aug. 27, 1996.

The acquisition and absorbency of the FAM with respect to the liquid pre-spotting compositions herein is superior to most other types of absorbent materials. For example, the FAM has a capacity of about 6 g ($H_2O$) per gram of foam at a suction pressure of 100 cm of water. By contrast, cellulose wood fiber structures have substantially no capacity above about 80 cm of water. Since, in the present process the volume of liquid pre-spotter used is relatively low (a few milliliters is typical) the amount of FAM used can be small. This means that the pad of FAM which underlays the stained area of fabric can be quite thin and still be effective. However, if too thin, the pad may tend to crumble, in-use. (as noted above, a backing sheet can be applied to the FAM to help maintain its integrity.)

Stain receiver pads made of FAM foam can be used in either of two ways. In one mode, the uncompressed foam is used. Uncompressed FAM pads having a thickness in the range of about 0.3 mm to about 15 mm are useful. In other mode, the FAM foam can be used in a compressed state which swells as liquid pre-spotter with its load of stain material is imbibed. Compressed FAM foams having thicknesses in the range of about 0.02 inches (0.5 mm) to about 0.135 inches (3.4 mm) are suitable herein.

The preparation of FAM foam (also sometimes referred to in the literature as "HIPE", i.e., high internal phase emulsion) is described in the patents cited hereinabove. The following illustrates the preparation of a compressed FAM foam for use herein having a thickness of about 0.025 inches (0.063 cm). Such compressed foams in the 0.025 in.–0.027 in. (0.063cm–0.068 cm) range are especially useful as the stain receiver herein.

Preparation of Emulsion and FAM Foams Therefrom

A) Emulsion Preparation

Anhydrous calcium chloride (36.32 kg) and potassium persulfate (189 g) are dissolved in 378 liters of water. This provides the water phase stream to be used in a continuous process for forming the emulsion.

To a monomer combination comprising distilled divinylbenzene (42.4% divinylbenzene and 57.6% ethyl styrene) (198 g), 2-ethylhexyl acrylate (3300 g), and hexanedioldiacrylate (720 g) is added a diglycerol monooleate emulsifier (360 g), ditallow dimethyl ammonium methyl sulfate (60 g), and Tinuvin 765 (15 g). The diglycerol monooleate emulsifier (Grindsted Products; Brabrand, Denmark) comprises approximately 81% diglycerol monooleate, 1% other diglycerol monoesters, 3% polyols, and 15% other polyglycerol esters, imparts a minimum oil/water interfacial tension value of approximately 2.7 dyne/cm and has an oil/water critical aggregation concentration of approximately 2.8 wt. %. After mixing, this combination of materials is allowed to settle overnight. No visible residue is formed and all of the mixture is withdrawn and used as the oil phase in a continuous process for forming the emulsion.

Separate streams of the oil phase (25° C.) and water phase (53°–55° C.) are fed to a dynamic mixing apparatus. Thorough mixing of the combined streams in the dynamic mixing apparatus is achieved by means of a pin impeller. The pin impeller comprises a cylindrical shaft of about 36.8 cm in length with a diameter of about 2.5 cm. The shaft holds 6 rows of pins, 3 rows having 33 pins and 3 rows having 32 pins, each having a diameter of 0.5 cm extending outwardly from the central axis of the shaft to a length of 2.5 cm. The pin impeller is mounted in a cylindrical sleeve which forms the dynamic mixing apparatus, and the pins have a clearance of 1.5 mm from the walls of the cylindrical sleeve.

A minor portion of the effluent exiting the dynamic mixing apparatus is withdrawn and enters a recirculation zone: see PCT U.S. Ser. No. 96/00082 published Jul. 18, 1996 and EPO Ser. No. 96/905110.1 filed Jan. 11, 1996. The Waukesha pump in the recirculation zone returns the minor portion to the entry point of the oil and water phase flow streams to the dynamic mixing zone.

The combined mixing and recirculation apparatus set-up is filled with oil phase and water phase at a ratio of 4 parts water to 1 part oil. The dynamic mixing apparatus is vented to allow air to escape while filling the apparatus completely. The flow rates during filling are 7.6 g/sec oil phase and 30.3 cc/sec water phase.

Once the apparatus set-up is filled the vent is closed. Agitation is then begun in the dynamic mixer, with the impeller turning at 1450 RPM and recirculation is begun at a rate of about 30 cc/sec. The flow rate of the water phase is then steadily increased to a rate of 151 cc/sec over a time period of about 1 min., and the oil phase flow rate is reduced to 3 g/sec over a time period of about 3 min. The recirculation rate is steadily increased to about 150 cc/sec during the latter time period. The back pressure created by the dynamic mixer and static mixing zone (TAH Industries Model Number 101–212) at this point is about 14.7 PSI (101.4 kPa), which represents the total back pressure of the system. The Waukesha pump speed is then steadily decreased to a yield a recirculation rate of about 75 cc/sec. The impeller speed in then steadily increased to 1550 RPM over a period of about 10 seconds. The back pressure increases to about 16.3 PSI (112 kPa).

B) Polmerization of Emulsion

The emulsion flowing from the static mixer is collected in a round polypropylene tub. 17 in. (43 cm) in diameter and 7.5 in (10 cm) high, with a concentric insert made of Celcon plastic. The insert is 5 in (12.7 cm) in diameter at its base and 4.75 in 12cm ) in diameter at its top and is 6.75 in (17.1 cm) high. The emulsion-containing tubs are kept in a room maintained at 65° C. for 18 hours to bring about polymerization and form the foam.

C) Foam Washing and Dewatering

The cured FAM foam is removed from the curing tubs. The foam at this point has residual water phase (containing dissolved emulsifier, electrolyte, initiator residues, and initiator) about 45–55 times (45–55X) the weight of polymerized monomers. The foam is sliced with a sharp reciprocating saw blade into sheets which are 0.185 inches (0.47 cm) in thickness. These sheets are then subjected to compression in a series of 2 porous nip rolls equipped with vacuum which gradually reduce the residual water phase content of the foam to about 6 times (6X) the weight of the polymerized material. At this point, the sheets are then resaturated with a 1.5% $CaCL_2$ solution at 60° C., are squeezed in a series of 3 porous nip rolls equipped with vacuum to a water phase content of about 4X. The $CaCl_2$ content of the foam is between 8 and 10%.

The foam remains compressed after the final nip at a thickness of about 0.025 in. (0.063 cm). The foam is then dried in air for about 16 hours. Such drying reduces the moisture content to about 9–17% by weight of polymerized material. At this point, the foam sheets are very drapeable. In this collapsed state, the density of the foam is about 0.14 g/cc.

As noted above, for use as a stain receiver in the pre-spotting operation herein, a sheet of the FAM is placed beneath and in close contact with the backside of the stained area of a fabric. A portion of pre-spotting composition is dispensed onto the frontside of the fabric from a bottle with a dispenser tip, and manipulated into the stain by means of the dispenser tip. Alternatively, the composition is worked into the stain using the convex cleaning devices described above. The excess pre-spotting composition and its load of stain material are thereby transferred through the fabric and into the underlying foam pad. The same holds true when the TBAL type of stain receiver is employed in the same manner.

While the compositions and processes of the present invention can be employed under any circumstances where fabric cleaning/refreshment is desired, they are especially useful in a non-immersion home "dry" cleaning/fabric refreshment process, as is described in more detail hereinafter.

PROCESS COMPONENTS

The use of the article with its vapor-permeable coversheet, the vapor-venting bag, the compositions and the processes of this invention are described in more detail hereinafter. Such disclosure is by way of illustration and not limitation of the invention herein. The definitional terms used herein have the following meanings.

By "aqueous" compositions herein is meant compositions which comprise a major portion of water, and optimally the butoxy propoxy propanol (BPP) or other cleaning solvents, the aforesaid surfactants or surfactant mixtures, hydrotropes, perfumes, and the like, especially those disclosed hereinafter.

By "cleaning" herein is meant the removal of soils and stains from fabrics. ("Spot cleaning" is the localized cleaning on areas of stain prior to the cleaning/refreshment step which is conducted in the venting bag.) By "refreshment" herein is meant the removal of malodors and/or wrinkles from the overall fabrics, or the improvement of their overall appearance, other than primarily removing soils and stains, although some soil and stain removal can occur concurrently with refreshment. Typical fabric cleaning refreshment/compositions herein can comprise more water (95–99.9%, preferably greater than 95% up to about 99%) and fewer cleaning ingredients than conventional cleaning or pre-spotting compositions.

By "contact with stained areas" with respect to the cleaning device is meant contact which is afforded by impingement of the protuberances, pads, sponges, etc., which comprise the treatment means of the device with the one side of the stained area. As noted above, it is highly desirable that this contact result in a force which is directed substantially downward, i.e., in the Z-direction substantially perpendicular to the surface of the stain, rather than a side-to-side scrubbing motion in the X- and Y-directions, to minimize fabric damage or "wear". Preferably, the contact is associated with a rocking motion by the convex device herein, whereby the curved surface of the device imparts the force in the Z-direction. By "contact with the stained areas" with respect to the stain receiver is meant that the side of the stained area of the fabric opposite the cleaning device directly impinges on the receiver and is in close communication therewith.

Figure 3:
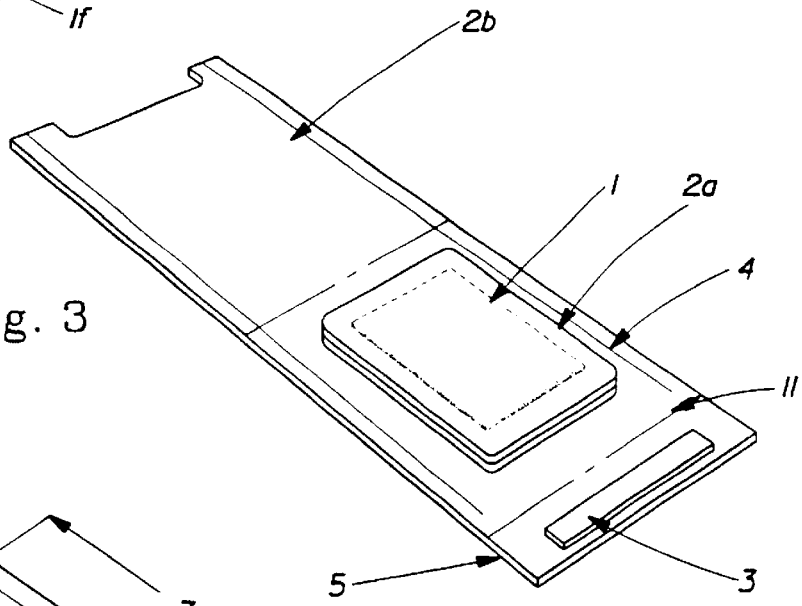
FIG. 3 is a perspective of the article loosely resting on a notched, vapor-venting containment bag which is in a pre-folded condition.

FIG. 3 illustrates on form of a pre-formed, notched containment bag in an open configuration with the loose article (1), first side wall (2*a*), second side wall (2*b*), first fastening device (3), side seal (4) for the bag and flexible flap (5). In use, flexible flap (5 is folded along fold line (11) to provide the vapor-venting closure for the bag.

FIG. 4 shows the "envelope-style" notched bag in a finished configuration and containing the loose article (1). In use, the fabrics to be cleaned/refreshed are placed in the bag with the article (1) and flap (5) is folded along fold line (11) to engage first fastening device (3) with the opposing second fastening device (6) to fasten the flap, thereby providing a vapor-venting closure which is sufficiently stable to withstand tumbling in a hot air clothes dryer or similar device.

FIG. 5 shows a cut-away view of the corner of the notched containment bag illustrating the interior of the first side wall (2*a*) and second side wall (2*b*), first fastening device (3), second fastening device (6), flap (5), and fold line (11). The distance between the edge of the bag (9) and the depth of the notch (11) in second side wall (2*b*) are dimensions which are set forth hereinabove.

FIG. 6 depicts an un-notched venting bag with the article (1) loosely contained therein.

The Bag Dimensions given hereinabove are for containment bags which are designed to tumble freely within the drum of a conventional, U.S.-style in-home hot air clothes dryer having a drum volume of about 170–210 liters (home size). The bag of the stated dimensions is designed to treat up to about 5 kg fabric load in a single use. The dimensions can be adjusted proportionately for larger or smaller bags to achieve the desired VVE and to ensure effective use in dryers with larger or smaller drums. For example, the total volume of a containment bag constructed for use in an average European home clothes dryer (or U.S. "apartment" size; ca. 90 liter drum volume) would be about 60% of the volume for an average U.S. dryer.

OVERALL PROCESS

The preferred pre-spotting procedure for removing stains from a stained area of fabrics, comprises applying a spot cleaning composition (preferably, substantially free of visible residues as described herein) to said stained areas, and rocking the device herein on the stain using hand pressure to remove it. In a preferred mode, in the pre-spotting step of the process herein the spot cleaning composition is applied to the fabric by any convenient means, e.g., by spraying, daubing, pouring, and the like. In an alternate mode, the pre-spotting process can be conducted by contacting the stained area during the rocking step with the carrier sheet which is saturated with the spot cleaning composition. Conveniently, the fabric and carrier sheet can be positioned in a holding tray or other suitable receptacle as a containment system for the cleaning composition.

In more detail, the overall process herein can be conducted in the following manner. Modifications of the process can be practiced without departing from the spirit and scope of the present invention.

1. Place the stained area of the fabric over and in contact with the FAM or TBAL stain receiver described herein or, less preferably, an ordinary folded paper towel (e.g., preferably white or non-printed—to avoid dye transfer from the towel—BOUNTY®°brand) on any suitable surface such as a table top, in a tray, etc.
2. Apply enough spot cleaning composition from a dispenser bottle with a narrow spout which directs the composition onto the stain (without unnecessarily saturating the surrounding area of the fabric) to saturate the localized stained area —about 10 drops; more may be used for a larger stain.
3. Optionally, let the composition penetrate the stain for 3–5 minutes. (This is a pre-treat or pre-hydration step for better cleaning results.)
4. Optionally, apply additional composition—about 10 drops; more may be used for larger stains.
5. Use the spot removal device or the dispenser tip on the dispenser bottle to work stain completely out. Rock the device (Z-direction force) firmly against the stain typically for 20–120 seconds, longer for tougher stains. Do not rub (X–Y direction force) the stain with the device or tip since this can harm the fabric. As shown in FIG. 7, the protuberances on the cleaning device are brought into close contact with the stain, e.g., by rocking the arcuate device on the stain, typically using hand pressure. Side-to-side rubbing with the device is preferably avoided to minimize potential fiber damage. Contact can be maintained for a period of 1–60 seconds for lighter stains and 1–5 minutes, or longer, for heavier or more persistent stains.
6. Optionally, blot the fabric, e.g., between paper towels, to remove excess composition. Or, the treated area can be blotted with a dampened sponge or other absorbent medium to flush the fibers and remove excess composition.
7. Conduct the in-dryer cleaning/refreshment process disclosed herein on the entire fabric using the article herein in the vapor-venting bag.
8. Following Step 7, it is preferred to promptly hang the slightly moist fabrics to avoid re-wrinkling and to complete the drying. Alternatively, the fabrics can be ironed.

An overall process for treating an entire area of fabric surface, which optionally comprises a prespotting operation according to this invention, thus comprises the overall steps of:

(i) optionally, conducting a stain removal process according to the above disclosure on localized stained areas of fabric;

(ii) placing the entire fabric together with the article herein releasably containing an aqueous fabric cleaning/refreshment composition in a vapor-venting containment bag;

(iii) placing the bag in a device to provide agitation, e.g., such as in a hot air clothes dryer and operating the dryer with heat and tumbling to moisten the fabric and provide vapor venting; and (iv) removing the fabric from the bag.

Again, the fabrics are promptly hung to complete drying and/or to prevent re-wrinkling.

The cleaning/refreshment step of the overall process is conveniently conducted in a tumbling apparatus, preferably in the presence of heat. The nylon or other heat-resistant vapor-venting bag with the article herein plus aqueous cleaning/refreshment composition and containing the optionally pre-spotted fabric being cleaned and refreshed is closed and placed in the drum of an automatic hot air clothes dryer at temperatures of 40° C.–150° C. The drum is allowed to revolve, which imparts a tumbling action to the bag and agitation of its contents concurrently with the tumbling. By virtue of this agitation, the fabrics come in contact with the article containing the composition. The tumbling and heating are carried out for a period of at least about 10 minutes, typically from about 20 minutes to about 60 minutes. This step can be conducted for longer or shorter periods, depending on such factors as the degree and type of soiling of the fabrics, the nature of the soils, the nature of the fabrics, the fabric load, the amount of heat applied, and the like, according to the needs of the user. During the step, greater than about 40%, typically 40% to about 80%, of the moisture is vented from the bag.

With respect to the wrinkle-removing function of the process and compositions herein, it will be appreciated that wrinkling can be affected by the type of fabric, the fabric weave, fabric finishes, and the like. For fabrics which tend to wrinkle, it is preferred not to overload the vapor-venting bag used herein. Thus, for a bag with, for example, an operational capacity of up to about 5 kg of fabrics, it may be best to process up to only about 60% of capacity, (i.e., up to about 3 kg) of fabrics to further minimize wrinkling.

The articles herein are designed to help minimize the formation of "wet strikes" on fabrics. This improvement in performance can be measured simply by using control garments made from the fabric known in the trade as "Sand-Washed Silk". This particular silk fabric readily shows visible wet strike marks. Thus, in a simple test, a Control comprising a HYDRASPUN fabric without the coversheet is compared with articles of the present type with respect to the formation of the wet strikes. In one convenient test method, a sand-washed silk blouse is split in half, placed in a containment bag of the present type with the uncovered HYDRASPUN 10444 carrier sheet with its load of liquid cleaning/refreshment composition and run through the in-bag process herein in a conventional home-style automatic hot air clothes dryer. The second half of the blouse is separately treated in the same fashion with the article of the present invention. Grading is done visually using any convenient scale, such as 0 for no wet strikes, up to 5 for a control run (i.e., maximum wet strikes on the half-blouse for the control article without the coversheet). In typical runs, the strike mark grades achievable by the present invention are in the range of 0–2.5 as compared with the 5.0 for the control.

If desired, the garments used in the test can be cleaned with a perchloroethylene/SANITONE® cleaning process by a commercial drycleaning establishment. The fabrics thus treated also give quite visible wet strike marks and are thus very useful in comparing the improved performance of the articles herein with articles without the coversheet herein.

The following Examples further illustrate the invention, but are not intended to be limiting thereof.

EXAMPLE I

A low residue liquid fabric cleaning/refreshment product for use in a vented dryer bag is prepared, as follows.

| Ingredient | % (wt.) |
|---|---|
| Emulsifier (TWEEN 20)* | 0.5 |
| Perfume | 0.5 |
| KATHON ® | 0.0003 |
| Sodium Benzoate | 0.1 |
| Water | Balance |

*Polyoxyethylene (20) sorbitan monolaurate available from ICI Surfactants.

A 10¼ in.×14¼ in. (26 cm×36 cm) carrier sheet of HYDRASPUN® is prepared. The carrier sheet is covered on both sides with a topsheet and a bottomsheet of 8 mil (0.2 mm) Reemay fabric coversheet material of the type described hereinabove. The coversheet (i.e., both topsheet and bottomsheet) are bonded to the carrier sheet by a Vertrod® or other standard heat sealer device, thereby bonding the laminate structure together around the entire periphery of the carrier sheet. The edges of the carrier sheet around its periphery are intercalated between the topsheet and bottomsheet by the bond. As noted above, the width of the bond is kept to a minimum and is about 0.25 in. (6.4 mm).

The bonded laminate structure thus prepared is folded and placed in a pouch. Any plastic pouch which does not leak would be suitable. For example, a foil laminated pouch of the type used in the food service industry can be employed. Such pouches are well-known in the industry and are made from materials which do not absorb food flavors. In like manner, the formulator herein may wish to avoid absorption of the perfume used in the cleaning/refreshment composition by the pouch. Various pouches are useful herein and are commercially available on a routine basis.

The folded carrier sheet/coversheet article is placed in the pouch. The folds can be of any type, e.g., an accordion-style fold, such that the final dimension of the folded sheet is about 13.5 cm×9.5 cm. This size is not critical but is convenient for placement in a pouch. 23 Grams of the liquid product are poured onto the carrier sheet/coversheet and allowed to absorb into it for a minimum of 30 minutes, preferably for about 4 hours. The pouch is sealed immediately after the liquid product is introduced into the pouch and stored until time-of-use.

As noted hereinabove, the carrier sheet can have holes punched therethrough in order to minimize its tendency to re-fold in-use. Indeed, the holes can be punched through the entire article, including the coversheet, itself, but this is not necessary. In a typical mode, for an article having the overall dimensions of about 27 cm×37 cm. 16 round holes, each about 0.5 in. (1.27 cm) in diameter are evenly spaced across the HYDRASPUN carrier sheet. The holes may be punched on the flat portions of the sheet, on the fold lines, or both. In a preferred mode, the holes are punched at the points where the fold lines intersect. Slits or other perforations may be used in like manner.

Step 1. A fabric to be cleaned and refreshed is selected. Localized stained areas of the fabric are situated over an absorbent stain receiver and are treated by directly applying about 0.5–5 mls (depending on the size of the stain) of the liquid product of Example II, III or IV, which is gently worked into the fabric using the convex device shown in FIG. 7. The treated stains are padded with dry paper toweling. In an alternate mode, the product is releasably absorbed on a carrier sheet and applied to the stains, which are then treated with the device, using a rocking motion, with hand pressure.

Step 2. Following the pre-spotting step, the fabric is placed into a vapor-venting nylon bag as shown in the Figures together with the sheet (which is removed from its storage pouch and unfolded) releasably containing the aforesaid cleaning/refreshment product. The mouth of the bag is closed to provide vapor-venting, and the bag and it contents are placed in the drum of a conventional hot air clothes dryer. The dryer is operated in standard fashion for 20–60 minutes at a high heat setting (an air temperature range of about 140–170° F.; 60–70° C.). After the tumbling action of the dryer ceases, the cleaned and refreshed fabric is removed from the bag. The used sheet is discarded. The fabric (which is preferably still slightly damp) is preferably hung on a conventional hanger to complete the drying process thereby further avoiding wrinkles.

EXAMPLE II

The optional pre-spotting operation herein for removing stain from a localized area on a fabric can also be conducted by:

(a) underlaying the area containing said stain with an absorbent stain receiver;

(b) applying a fluid cleaner (pre-spotter) composition to said stain from a container having a dispenser spout and (c) rubbing or pressing said cleaning composition into said stain using the distal tip of said spout, whereby said stain is transferred into the stair receiver.

In this mode, the face of the distal tip of said spout can be concave, convex, flat, or the like. The combination of container plus spot is referred to herein conjointly as the "dispenser".

A typical dispenser herein has the following dimensions, which are not to be considered limiting thereof. The volume of the container bottle used on the dispenser is typically 2 oz.–4 oz. (fluid ounces; 59 mls to 118 mls). The container larger size bottle can be high density polyethylene. Low density polyethylene is preferably used for the smaller bottle since it is easier to squeeze. The overall length of the spout is about 0.747 inches (1.89 cm). The spout is of a generally conical shape, with a diameter at its proximal base (where it joins with the container bottle) of about 0.596 inches (1.51 cm) and at its distal tip of about 0.182 inches (4.6 mm). The diameter of the channel within the spout through which the pre-spotting fluid flows is approximately 0.062 inches (1.57 mm). In this embodiment, the channel runs from the container bottle for a distance of about 0.474 inches (1.2 cm) and then expands slightly as it communicates with the concavity to form the exit orifice at the distal tip of the spout.

A pre-spotting formula for use herein with the aforesaid dispenser and a TBAL or FAM-foam stain receiver is as follows.

| INGREDIENT | % (Wt.) (Nonionic) | Range % (Wt.) |
|---|---|---|
| Hydrogen peroxide | 1.000 | 0–2 |
| Amino tris(methylene phosphonic acid)* | 0.040 | 0–0.06 |
| Butoxypropoxypropanol (BPP) | 2.000 | 1–6 |
| Neodol 23 6.5 | 0.250 | 0–1 |
| Kathon preservative | 0.0003 | Optional** |
| Water | 96.710 | Balance |

pH target = 7; range = 6–8
*Stabilizer for hydrogen peroxide
**Sufficient to provide a preservative function.

EXAMPLE III

Other compositions for use as pre-spotters, or on a sheet substrate in a hot air clothes dryer in combination with the venting bags in the manner disclosed herein, are as follows. Such high water compositions are especially useful in reducing wrinkles in the cleaned fabrics.

| INGREDIENT | PERCENT (wt.) | (RANGE) |
|---|---|---|
| NEODOL 23 - 6.5 | 1.00 | 0.7–1.5 |
| BPP | 9.2 | 8.0–10.0 |
| 1.2-Octanediol | 0.65 | 0–1.0 |
| Perfume | 1.00 | 0.5–1.5 |
| PEMULEN TR-1 | 0.125 | 0–0.2 |
| KOH | 0.063 | 0.024–0.10 |
| KCl | 0.075 | 0.02–0.20 |
| KATHON CG | 0.0003 | 0.0001–0.001 |
| Water | 87.887 | Balance (typically 85–88%) |

Besides the other ingredients, the foregoing compositions can contain enzymes to further enhance cleaning performance. Lipases, amylases and protease enzymes, or mixtures thereof, can be used. If used, such enzymes will typically comprise from about 0.001% to about 5%, preferably from about 0.01% to about 1%, by weight, of the composition. Commercial detersive enzymes such as LIPOLASE, ESPERASE, ALCALASE, SAVINASE and TERMAMYL (all ex. NOVO) and MEXATASE and RAPIDASE (ex. International Bio-Synthesis, Inc.) can be used.

If an antistatic benefit is desired, the compositions used herein can contain an anti-static agent. If used, such anti-static agents will typically comprise at least about 0.5%, typically from about 2% to about 8%, by weight, of the compositions. Preferred anti-stats include the series of sulfonated polymers available as VERSAFLEX 157, 207, 1001, 2004 and 7000, from National Starch and Chemical Company.

The following examples illustrate preferred embodiments of the present invention in more detail, but are not intended to be limiting thereof.

EXAMPLE IV

Another example of a preferred, high water content, low residue composition for use in the pre-spotting step herein is as follows.

| INGREDIENT | Anionic Composition (%) |
|---|---|
| Hydrogen peroxide | 1.000 |
| Amino tris(methylene phosphonic acid)* | 0.0400 |
| Butoxypropoxypropanol (BPP) | 2.000 |
| $NH_4$ Coconut $E_3S$ | 0.285 |
| Dodecyldimethylamine oxide | 0.031 |
| Magnesium chloride | 0.018 |
| Magnesium sulfate | 0.019 |
| Hydrotrope, perfume, other minors. | 0.101 |
| Kathon preservative | 0.0003 |
| Water (deionized or distilled) | 96.507 |
| Target pH | 6.0 |

*Stabilizer for hydrogen peroxide

Preferably, to minimize the potential for dye damage as disclosed hereinabove, $H_2)_2$—containing pre-spotting compositions comprise the anionic or nonionic surfactant in an amount (by weight of composition) which is less than the amount of $H_2O_2$. Preferably, the weight ratio of surfactant:$H_2O_2$ is in the range of abut 1:10 to about 1:1.5, most preferably about 1:4 to about 1:3.

What is claimed is:

1. An article for treating fabrics in a hot air clothes dryer, comprising by:

a) an absorbent carrier substrate; and b) a liquid cleaning/refreshment composition releasably absorbed in said substrate, said substrate being wholly or partly covered by;

c) a fibrous coversheet which is permeable to said cleaning/refreshment composition; wherein said coversheet has a minimum thickness of at least about 8 mils; wherein said article cleans and refreshes said fabrics without leaving water marks.

2. An article according to claim 1, wherein said coversheet substantially encases said substrate.

3. An article according to claim 1 wherein said substrate is in the form of a sheet.

4. An article according to claim 1 wherein said substrate is bonded to said coversheet at discrete areas, whereby, in-use, said substrate is maintained in its original configuration relative to the coversheet.

5. An article according to claim 1 wherein the carrier substrate is a hydroentangled fabric.

6. An article according to claim 1 wherein the cleaning/refreshment composition comprises water and a member selected from the group consisting of organic solvents, organic surfactants, auxiliary cleaning agents, and mixtures thereof.

7. An article according to claim 1 wherein the cleaning/refreshment composition comprises water and a surfactant.

8. An article according to claim 7 wherein the surfactant is a nonionic surfactant.

9. An article according to claim 8 wherein the cleaning/refreshment composition comprises a mixture of water and a surfactant which is an ethoxylated alcohol or ethoxylated alkyl phenol.

10. An overall non-immersion cleaning/refreshment process for treating a fabric, which optionally comprises a prespotting operation, and comprising the overall steps of:

(a) optionally, applying a spot cleaning composition from a dispenser to a discrete stained area of said fabric;

(b) optionally, concurrently or consecutively with Step (a), contacting the stained area of the fabrics with the treatment members of a convex cleaning device or with a dispenser tip affixed to said dispenser, and applying Z-direction force to said device or to said tip;

(c) placing the fabric together with an article according to claim 1 in a containment bag;

(d) placing the bag in a hot air clothes dryer, or the like apparatus, and operating said apparatus with heat and tumbling; and (e) removing the fabric from the bag.

11. A process according to claim 10 wherein vapors are vented from the bag during step (d).

12. A kit, comprising:

(a) multiple articles according to claim 1;

(b) a re-usable containment bag;

(c) optionally, a convex cleaning device;

(d) optionally, a separate portion of a spot cleaning composition;

(e) optionally, a re-usable holding tray; and (of) optionally, one or more absorbent stain receivers.

13. An article of manufacture according to claim 1 in sheet form which is specifically adapted to clean and/or refresh fabrics in a hot air clothes dryer, comprising:

(a) a core element which comprises a liquid absorbing carrier substrate in sheet form;

(b) from about 10 grams to about 30 grams of a liquid cleaning/refreshment composition comprising at least about 95%, by weight, of water releasably absorbed in said core element;

(c) a permeable fibrous coversheet which encases the outer surfaces of said core element.

14. An article according to claim 13 wherein said cleaning/refreshment composition comprises up to about 2%, by weight, of a nonionic surfactant.

15. An article according to claim 13 wherein the substrate is bonded to said coversheet in discrete areas.

* * * * *